US007871152B2

(12) United States Patent
Suzuki et al.

(10) Patent No.: US 7,871,152 B2
(45) Date of Patent: Jan. 18, 2011

(54) DISCHARGE HEAD AND METHOD FOR PRODUCING DISCHARGE HEAD

(75) Inventors: Shigeru Suzuki, Nagoya (JP); Shuhei Hiwada, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 372 days.

(21) Appl. No.: 12/163,616

(22) Filed: Jun. 27, 2008

(65) Prior Publication Data

US 2009/0002461 A1 Jan. 1, 2009

(30) Foreign Application Priority Data

Jun. 27, 2007 (JP) ..... 2007-168730

(51) Int. Cl.
*B41J 2/14* (2006.01)

(52) U.S. Cl. ..... 347/50; 347/58

(58) Field of Classification Search ..... 347/50, 347/57, 58, 59, 67–68
See application file for complete search history.

(56) References Cited

U.S. PATENT DOCUMENTS

| | | | | |
|---|---|---|---|---|
| 5,521,621 | A * | 5/1996 | Endo et al. | 347/15 |
| 5,754,194 | A * | 5/1998 | Endo et al. | 347/15 |
| 2004/0113994 | A1 | 6/2004 | Shinkai | |
| 2007/0159511 | A1 | 7/2007 | Shinkai | |

FOREIGN PATENT DOCUMENTS

| | | | |
|---|---|---|---|
| JP | H07-156376 | A | 6/1995 |
| JP | H08-156252 | A | 6/1996 |
| JP | H09-298018 | A | 11/1997 |
| JP | 2004-136663 | A | 5/2004 |
| JP | 2007-012908 | A | 1/2007 |

OTHER PUBLICATIONS

Satoshi Suzuki et al., "Properties of Pd Plated Electronic Contact," Furukawa Review No. 106 (Jul. 2000), pp. 46-50. (A concise explanation of relevance of this Japanese language reference is incorporated into the specification of the above-captioned patent application at Para. [0067].).

* cited by examiner

*Primary Examiner*—Lamson D Nguyen
(74) *Attorney, Agent, or Firm*—Baker Botts L.L.P.

(57) ABSTRACT

A discharge head includes a discharge driving element; an individual electrode formed on the discharge driving element and having a connecting section; and a wired board having a terminal which is joined to the individual electrode by a conductive brazing material. The connecting section is provided to face the terminal, and a metal, which is hardly sulfurized, is exposed in a facing area, of a surface of the connecting section, facing the terminal. A silver sulfide coating is formed on a surface of the connecting section except for a portion facing the terminal. The silver sulfide coating has a low affinity for the conductive brazing material, which is hardly wetted thereby. Therefore, even when the conductive brazing material leaks, then the conductive brazing material is not retained on the silver sulfide coating, and no influence is exerted on the driving operation of the discharge head.

23 Claims, 11 Drawing Sheets

DISCHARGE HEAD AND METHOD FOR PRODUCING DISCHARGE HEAD

CROSS-REFERENCE TO RELATED APPLICATION

The present application claims priority from Japanese Patent Application No. 2007-168730, filed on Jun. 27, 2007, the disclosure of which is incorporated herein by reference in its entirety.

BACKGROUND OF THE INVENTION

1. Field of the Invention

The present invention relates to a discharge head which is provided with a discharge driving element and a printed circuit board or wired board connected thereto, and a method for producing the discharge head.

2. Description of the Related Art

As for the discharge head, for example, a liquid droplet discharge head (ink-jet head) is already known, which is provided for a liquid droplet discharge apparatus such as an ink-jet printer. The ink-jet head is provided with a plurality of pressure chambers, nozzles, and piezoelectric elements. The liquid is supplied from a liquid supply source to the pressure chambers. The volume of the pressure chambers is changed by deforming the piezoelectric elements each of which is arranged opposingly to one of the pressure chambers. Accordingly, the pressure is applied to the liquid contained in the pressure chambers, and the liquid is discharged from the nozzles connected to the pressure chambers.

Surface electrodes are formed on the piezoelectric elements so that the surface electrodes are opposed to the pressure chambers. The driving signal is applied to the surface electrodes by the aid of a circuit board or wired board such as a flexible wiring member. Accordingly, the electric field is applied to the piezoelectric elements to deform the piezoelectric elements. The wired board includes a wiring which transmits various signals such as the driving signal supplied from the apparatus to the discharge head via a driver IC, and terminals which correspond to the surface electrodes. The terminals are connected to the surface electrodes, respectively, and thus the driving signal is transmitted to the surface electrodes via the wired board.

In general, the terminals of the wired board and the connecting portions of the surface electrodes are connected to one another such that a conductive brazing material such as solder is allowed to intervene between the terminals of the wired board and the connecting portions of the surface electrodes, and the conductive brazing material is melted by being heated (see Japanese Patent Application Laid-open No. 7-156376, page 3, FIG. 10). On the other hand, the terminal and the connecting portion are connected to one another without the conductive brazing material in some cases as described in Japanese Patent Application Laid-open No. 8-156252 (page 3, FIG. 2). When the conductive brazing material is not used, a cutout portion, which has an areal size larger than that of each of the surface electrodes, is provided in a lower film of two stacked films possessed by a printed circuit board. Further, a terminal, which has an areal size smaller than that of each of the surface electrodes, is formed on the lower surface of the upper film disposed in the cutout portion. A conductive adhesive is applied dropwise to the surface of each of the surface electrodes, and then the terminals are pressurized against the surface electrodes. Accordingly, the terminals and the surface electrodes are electrically connected to one another. The connecting portions between the terminals and the surface electrodes are disposed at the positions opposed to the pressure chambers.

SUMMARY OF THE INVENTION

When the technique, in which the terminals of the wired board are connected to the connecting portions of the surface electrodes by the conductive brazing material, is adopted, the conductive brazing material, which has the high fluidity by being heated and melted, is moved from the positions between the connecting portions of the surface electrodes and the terminals of the wired board to the areas of the surface electrodes opposed to the pressure chambers in some cases. In such a situation, the deformation of the piezoelectric elements is consequently inhibited or obstructed by the rigidity possessed by the conductive brazing material.

This fact results in the decrease in the liquid droplet discharge performance. In order to avoid such an inconvenience, for example, the distance of the jointed portions between the terminals and the surface electrodes are prolonged in some cases. However, this countermeasure is disadvantageous in order to realize the high integration. Further, when the surface electrodes are composed of a metal, if the conductive brazing material is adhered to the surface electrodes, then the metal of the surface electrodes tends to be diffused in the conductive brazing material. If such a situation arises, then the resistance is increased between the surface electrodes and the terminals, and the electric disconnection may arise in the worst case.

When the surface electrodes, which are provided corresponding to the plurality of pressure chambers respectively, are jointed to the plurality of terminals which correspond to the surface electrodes respectively, the conductive brazing material, which has the high fluidity by being melted, may cause the short circuit between the adjoining joined portions.

On the other hand, when another technique, in which the conductive adhesive is used in place of the conductive brazing material, is adopted, the conductive adhesive remains in the cutout portions formed in the lower film of the printed circuit board, because the fluidity of the conductive adhesive, which is brought about when the conductive adhesive is heated, is smaller than that of the conductive brazing material. Therefore, this technique mitigates the problems of the inhibition of the deformation of the piezoelectric element, the increase in the connection resistance, the disconnection, and the short circuit formation as caused when the conductive brazing material is used as described above. However, as described above, the joined portions between the terminals and the surface electrodes are disposed at the positions opposed to the pressure chambers. Therefore, a problem arises such that the deformation of the piezoelectric elements is inhibited when the liquid droplets are discharged. This fact results in the decrease in the ink discharge performance, because it is difficult to change the volume of the pressure chambers.

An object of the present invention is to provide a discharge head which makes it possible to reliably connect discharge driving elements and a wired board and which suppresses the inhibition or obstruction of the deformation of a piezoelectric element, and a method for producing the same.

According to a first aspect of the present invention, there is provided a discharge head which discharges a liquid, including:

a discharge driving element which applies a discharge pressure to the liquid;

an individual electrode which is formed on the discharge driving element and which has a predetermined connecting section; and a wired board which has a terminal connected to the connecting section of the individual electrode and which is joined to the individual electrode with a conductive brazing material bridging between the terminal and the individual electrode, wherein the connecting section is provided to face the terminal, and a metal, which is hardly sulfurized, is exposed in a facing area of a surface of the connecting section facing the terminal; and a silver sulfide coating is formed on a portion, of a surface of the individual electrode, facing the terminal, the portion being different from the connecting section.

According to the first aspect of the present invention, the connecting section is provided opposingly to the terminal, and the metal, which is hardly sulfurized, is exposed on the opposing surface. Therefore, the connecting section is hardly sulfurized, and the conductive brazing material is reliably adhered. Therefore, the discharge head according to the present invention is provided with the individual electrode wherein the terminal and the connecting section are joined and connected to one another mechanically and electrically. Further, the silver sulfide coating, which has no affinity for the conductive brazing material, is formed on the portion of the surface of the individual electrode except for the connecting section at least on the surface disposed on the side opposed to the terminal. Therefore, when the conductive brazing material leaks from the area interposed by the terminal and the connecting section, the conductive brazing material does not leak to the concerning portion. The discharge head is provided, in which any excessive conductive brazing material is not adhered to those other than the desired connecting section. It is possible to avoid any inhibition or obstruction including, for example, the electric disconnection and the short circuit formation which would be otherwise caused by the leaked conductive brazing material.

In the discharge head of the present invention, a coating of the metal which is hardly sulfurized may be formed in the facing area of the connecting section.

In this arrangement, the connecting section is at least a part of the individual electrode, and the metal coating or film, which is hardly sulfurized, is formed on at least the surface of the individual electrode opposed to the terminal. Therefore, even when any connecting portion to make the connection to the terminal is not formed distinctly, the connecting section can be formed on the surface of the part of the individual electrode. Further, the joining and the connection can be reliably effected electrically and mechanically with respect to the conductive brazing material, because the connecting section is hardly sulfurized. Even when the connecting section exists on the surface of the part of the individual electrode, any excessive conductive brazing material is not adhered to any portion except for the desired connecting section, because the silver sulfide coating or film is formed on the portion other than the connecting section on at least one surface to make the connection to the terminal by the aid of the conductive brazing material. Therefore, it is possible to avoid any inhibition including, for example, the electric disconnection and the short circuit formation which would be otherwise caused by the leaked conductive brazing material.

In the discharge head of the present invention, the connecting section may be arranged closely to the individual electrode; the connecting section may be electrically connected to the individual electrode; and the connecting section may be formed of the metal which is hardly sulfurized, or a coating of the metal may be formed on the facing area.

In this arrangement, the connecting section is arranged closely to the individual electrode. Further, the connecting section is formed of the metal which is hardly sulfurized, or the metal coating is formed on the opposing surface of the connecting section. Therefore, any excessive conductive brazing material is not adhered to any portion except for the desired connecting section. It is possible to avoid any inhibition including, for example, the electric disconnection and the short circuit formation which would be otherwise caused by the leaked conductive brazing material. In this application, the metal, which is hardly sulfurized, includes any mixture containing the metal.

In the discharge head of the present invention, the connecting section may be a connecting electrode section which is provided as a connecting terminal formed on the surface of the individual electrode.

In this arrangement, the connecting section is the connecting terminal formed on the individual electrode surface. Therefore, it is possible to effect the joining and the connection more reliably with respect to the terminal of the wired board by the aid of the conductive brazing material.

In the discharge head of the present invention, a coating of the metal which is hardly sulfurized may be formed in an area of a surface of the connecting electrode section, the area facing the terminal.

In this arrangement, the metal coating, which is hardly sulfurized, is formed on at least the surface disposed on the side opposed to the terminal, of the surface of the connecting electrode section. Therefore, the connecting electrode section is hardly sulfurized. The terminal and the connecting electrode section are reliably joined and connected to one another electrically and mechanically by means of the conductive brazing material. Further, the silver sulfide coating is formed on the portion of the surface of the individual electrode other than the connecting electrode section. Therefore, any excessive conductive brazing material is not adhered to any portion except for the desired connecting section. Therefore, it is possible to avoid any inhibition including, for example, the electric disconnection and the short circuit formation which would be otherwise caused by the leaked conductive brazing material.

In the discharge head of the present invention, the connecting electrode section may be formed of the metal which is hardly sulfurized.

In this arrangement, the connecting electrode section is formed of the metal which is hardly sulfurized, or of any mixture containing the metal. Therefore, it is possible to effect the joining and the connection mechanically and electrically between the connecting electrode section and the terminal. Further, the silver sulfide coating is formed on the portion except for the connecting electrode section on the surface of the individual electrode. Therefore, any excessive conductive brazing material is not adhered to any portion except for the desired connecting section. Therefore, it is possible to avoid any inhibition including, for example, the electric disconnection and the short circuit formation which would be otherwise caused by the leaked conductive brazing material.

In the discharge head of the present invention, the discharge head may have a flow passage unit which has a plurality of pressure chambers and wall sections comparting the plurality of pressure chambers respectively; the discharge driving element may be an actuator arranged on the flow passage unit; the individual electrode may be formed as a plurality of individual electrodes on the actuator, each of the individual electrodes having a main electrode section which faces one of the pressure chambers and a subsidiary electrode section which faces one of the wall sections; the subsidiary electrode section may be the connecting section; and the silver sulfide coating may be formed on an area of a surface of the main electrode section, the area facing the terminal.

In this arrangement, the silver sulfide coating is formed on the main electrode section of the actuator corresponding to the pressure chamber. Therefore, the conductive brazing material causes neither inflow nor adhesion. The displacement (vibration) of the actuator to apply the discharge pressure to the pressure chamber is not inhibited or obstructed. Therefore, the discharge head is provided, which is capable of stably performing the discharge without exerting any influence on the ink discharge characteristic. Further, it is also possible to avoid the short circuit formation which would be otherwise caused by the leakage of the conductive brazing material in relation to the joining with respect to the terminals among the plurality of individual electrodes.

In the discharge head of the present invention, the discharge head may have a flow passage unit which has a plurality of pressure chambers and wall sections comparting the plurality of pressure chambers respectively; the discharge driving element may be an actuator, arranged on the flow passage unit; the individual electrode may be formed as a plurality of individual electrodes on the actuator, each of the individual electrodes having a main electrode section which faces one of the pressure chambers and a subsidiary electrode section which faces one of the wall sections; and the connecting electrode section may be formed on the subsidiary electrode section, the silver sulfide coating being formed on an area, of a surface of the main electrode section, facing the terminal.

In this arrangement, the silver sulfide coating is formed on the main electrode section of the actuator corresponding to the pressure chamber. Therefore, the conductive brazing material causes neither inflow nor adhesion. The displacement (vibration) of the actuator to apply the discharge pressure to the pressure chamber is not inhibited or obstructed. Therefore, the discharge head is provided, which is capable of stably performing the discharge without exerting any influence on the ink discharge characteristic. Further, it is also possible to avoid the short circuit formation which would be otherwise caused by the leakage of the conductive brazing material in relation to the joining with respect to the terminals among the plurality of individual electrodes.

In the discharge head of the present invention, the individual electrode may be a silver electrode, the conductive brazing material may be solder, and the metal, which is hardly sulfurized, may be gold.

In this arrangement, the terminal and the connecting section or the connecting electrode section can be joined and connected to one another mechanically and electrically by the aid of the solder, because the individual electrode is the silver electrode, the conductive brazing material is solder, and the metal, which is hardly sulfurized, is gold. Owing to the fact that the individual electrode is the silver electrode, the silver sulfide coating can be formed on the surface of the main electrode section other than the connecting section or the connecting electrode section on the surface of the individual electrode.

In the discharge head of the present invention, the coating of the metal which is hardly sulfurized may have a thickness of 0.01 to 0.1 μm.

In this arrangement, it is possible to provide the satisfactory affinity for the conductive brazing material, and it is possible to effect the joining and the connection mechanically and electrically. The metal coating can be formed with ease by means of the plating treatment because of the thin film thickness of about 0.01 to 0.1 μm.

In the discharge head of the present invention, the silver sulfide coating may have a thickness of 0.2 to 0.3 μm.

In this arrangement, the silver sulfide coating is provided, which has such a film thickness that the state of the defective affinity for the conductive brazing material is exhibited and maintained. It is possible to avoid any adhesion of the conductive brazing material to the main electrode section on which the coating is formed.

According to a second aspect of the present invention, there is provided a method for producing a discharge head, including:

preparing a flow passage unit which has a plurality of pressure chambers and wall sections comparting the plurality of pressure chambers respectively;

arranging, on the flow passage unit, an actuator which applies a discharge pressure to each of the pressure chambers, the actuator including a plurality of individual electrodes formed thereon, and a wired board which has terminals, each of the individual electrodes having a main electrode section corresponding to one of the pressure chambers and a subsidiary electrode section corresponding to one of the wall sections, and facing each of the terminals, and the wired board being electrically connected to the actuator by joining an area between each of the terminals and the subsidiary electrode section with a conductive brazing material; and providing each of the individual electrodes as a silver electrode, and forming a silver sulfide coating on a surface of each of the individual electrodes before joining each of the terminals and the subsidiary electrode section.

According to the second aspect of the present invention, the silver sulfide coating, which has no affinity for the conductive brazing material, is formed on one surface of the main electrode section, before being joined to the terminal of the wired board. Therefore, when the joining is performed by means of the conductive brazing material, any excessive conductive brazing material is not adhered to one surface of the main electrode section. It is possible to produce the discharge head in which the displacement of the actuator exerts no influence on the discharge pressure to be applied to the pressure chamber. Further, it is possible to produce the discharge head which makes it possible to avoid the inhibition or obstruction including, for example, the electric disconnection and the short circuit formation which would be otherwise caused by the leaked conductive brazing material.

In the method for producing the discharge head of the present invention, a metal coating, of a metal which is hardly sulfurized, may be formed on an area, of the subsidiary electrode section, facing the terminal, the surface of each of the individual electrodes may be thereafter sulfurized, the silver sulfide coating may be formed only on a surface of the silver electrode of the main electrode section, and then the subsidiary electrode section and each of the terminals may be joined to each other with the conductive brazing material.

In this procedure, the silver sulfide coating, which has no affinity for the conductive brazing material, can be easily formed on the main electrode section on which any metal coating to be hardly sulfurized is not formed, merely by performing the sulfurizing treatment uniformly for the entire surface of the individual electrode after the metal coating to be hardly sulfurized is formed on only the connecting section which is desired to be joined to the terminal of the wired board. Therefore, the terminal and the connecting section can be joined to one another at only the desired connecting portion by means of the conductive brazing material.

According to a third aspect of the present invention, there is provided a method for producing a discharge head, including:

preparing a flow passage unit which has a plurality of pressure chambers and wall sections comparting the plurality of pressure chambers respectively;

arranging, on the flow passage unit, an actuator which applies a discharge pressure to each of the pressure chambers, the actuator including a plurality of individual electrodes formed thereon, and a wired board having terminals, each of the individual electrodes having a main electrode section corresponding to one of the pressure chambers and a subsidiary electrode section corresponding to one of the wall sections and having a connecting electrode section formed on the subsidiary electrode section, each of the terminals facing the connecting electrode section, and the wired board being electrically connected to the actuator by joining an area between each of the terminals and the connecting electrode section with a conductive brazing material; and providing each of the individual electrodes as a silver electrode, and forming a silver sulfide coating in area, of the main electrode section and the subsidiary electrode section, facing each of the terminals before joining the connecting electrode section and each of the terminals.

According to the third aspect of the present invention, the silver sulfide coating, which has no affinity for the conductive brazing material, is formed on the surfaces of the main electrode section and the connecting section other than the connecting electrode section, before being joined to the terminal of the wired board. Therefore, when the joining treatment is performed, any excessive conductive brazing material is not adhered to any portion other than the connecting electrode section. It is possible to produce the discharge head in which the displacement of the piezoelectric type actuator exerts no influence on the discharge pressure to be applied to the pressure chamber. Further, it is possible to produce the discharge head which makes it possible to avoid the inhibition or obstruction including, for example, the electric disconnection and the short circuit formation which would be otherwise caused by the leaked conductive brazing material.

In the method for producing the discharge head of the present invention, a metal coating, of a metal which is hardly sulfurized, may be formed on an area of a surface of the connecting electrode section, the area facing each of the terminals; a surface of each of the individual electrodes may be thereafter sulfurized; the silver sulfide coating may be formed on a surface of the silver electrode of the main electrode section and a surface of the subsidiary electrode section, and then the connecting electrode section and each of the terminals may be joined to each other with the conductive brazing material.

In this procedure, the silver sulfide coating, which has no affinity for the conductive brazing material, can be easily formed on the main electrode section on which any metal coating to be hardly sulfurized is not formed, merely by performing the sulfurizing treatment uniformly for the entire surface of the individual electrode after the metal coating to be hardly sulfurized is formed on only the connecting electrode section which is desired to be joined to the terminal of the wired board. Therefore, the terminal and the connecting electrode section can be joined to one another at only the desired connecting portion by means of the conductive brazing material.

In the method for producing the discharge head of the present invention, the subsidiary electrode section may be formed of a metal which is hardly sulfurized, the main electrode section may be formed of silver, the surface of each of the individual electrodes is sulfurized, and the silver sulfide coating may be formed on the main electrode section, before the connecting section and each of the terminals are joined to each other with the conductive brazing material. Alternatively, the connecting electrode section may be formed of a metal which is hardly sulfurized; the main electrode section may be formed of silver; a surface of each of the individual electrodes may be sulfurized and the silver sulfide coating may be formed on the main electrode section, before the connecting electrode section and each of the terminals are joined to each other with the conductive brazing material.

In any case, only the terminal of the wired board and the connecting section (the subsidiary electrode section) or the connecting electrode section for which the joining is desired can be joined and connected to one another electrically and mechanically by means of the conductive brazing material. Further, the connecting section or the connecting electrode section is formed of the metal which is hardly sulfurized or the mixture which contains the metal. Therefore, the silver sulfide coating, which has no affinity for the conductive brazing material, can be easily formed on the main electrode section by merely performing the sulfurizing treatment uniformly for the entire surface of the individual electrode.

In the method for producing the discharge head of the present invention, the metal coating, of the metal which is hardly sulfurized, may have a thickness of 0.01 to 0.1 μm In this procedure, even when the entire surface of the individual electrode is subjected to the sulfurizing treatment thereafter, the portion, on which the production of silver sulfide is not permitted, can be previously formed. Further, the desired metal coating can be easily formed by means of the plating treatment, because the film thickness is thin, i.e. about 0.01 to 0.1 μm.

In the method for producing the discharge head of the present invention, the silver sulfide coating may have a thickness of 0.2 to 0.3 μm.

In this procedure, the silver sulfide coating has the sufficient film thickness to exhibit and maintain such a state that no affinity is provided for the conductive brazing material, and the wettability of the conductive brazing material is defective. The silver sulfide coating can be easily formed by means of the sulfurizing treatment to effect the immersion in the sulfurizing solution or the sulfurizing gas.

In the method for producing the discharge head of the present invention, sulfurization may be performed by a sulfurizing treatment in which exposure is effected for a predetermined period of time in a hydrogen sulfide atmosphere.

In this procedure, the electrode section, which has no affinity for the conductive brazing material and which is defective in the wettability, can be easily produced merely by exposing the individual electrode for the predetermined period of time in the hydrogen sulfide atmosphere, the individual electrode having the metal coating which is hardly sulfurized and which is formed on the desired portion.

According to the present invention, the connecting section or the connecting electrode section of the individual electrode, which is possessed by the discharge head, is reliably joined to the terminal of the wired board by means of the conductive brazing material. Further, the conductive brazing material is not allowed to leak to the main electrode section of the actuator corresponding to the pressure chamber. It is possible to produce the discharge head in which the vibration of the actuator is not inhibited, and the ink is discharged normally. The wired board and the actuator are reliably connected electrically to one another. It is possible to obtain the discharge head in which the displacement of the actuator does not exert any influence on the discharge pressure to be applied to the pressure chamber.

BRIEF DESCRIPTION OF THE DRAWINGS

FIGS. 1A and 1B show magnified plan views illustrating individual electrodes 1 according to the present invention, wherein FIG. 1A shows the individual electrode 1A of a first embodiment, and FIG. 1B shows the individual electrode 1B of the second embodiment.

FIGS. 2A and 2B show a step of joining the individual electrode 1A of the first embodiment and a wired board 50, wherein FIG. 2A shows a state before the joining, and FIG. 2B shows a state after the joining.

FIGS. 3A and 3B show a step of joining the individual electrode 1B of the second embodiment and a wired board 50, wherein FIG. 3A shows a state before the joining, and FIG. 3B shows a state after the joining.

FIGS. 4A, 4B and 4C show modified embodiments of the individual electrodes 1A and 1B of the first and second embodiments, wherein FIG. 4A shows a first modified embodiment of the individual electrode 1A of the first embodiment, FIG. 4B shows a second modified embodiment of the individual electrode 1A of the first embodiment, and FIG. 4C shows a third modified embodiment of the individual electrode 1B of the second embodiment.

FIGS. 5A and 5B illustrate an ink-jet head H, wherein FIG. 5A shows a perspective view, and FIG. 5B shows a sectional view taken along a line VB-VB.

FIGS. 10A and 10B show an exemplary actuator unit, wherein FIG. 10A shows a sectional view, and FIG. 10B shows a plan view illustrating an individual electrode.

DESCRIPTION OF THE PREFERRED EMBODIMENTS

Embodiments of the present invention will be explained in detail below on the basis of the drawings. At first, with reference to FIGS. 1A to 3B, an explanation will be made about the individual electrodes possessed by the discharge head according to the present invention. In the following description, with reference to FIGS. 2A, 2B and FIGS. 3A, 3B, the side, on which the individual electrodes are opposed to the terminals of the wiring member, is designated as the upper side or the upward direction, the other side, which is opposite thereto, is designated as the lower side or the downward direction, the side of the individual electrode, which is disposed on the side of the main electrode, is designated as the right side or the rightward direction, and the side, which is opposite thereto, is designated as the left side or the leftward direction.

Figure 1A:
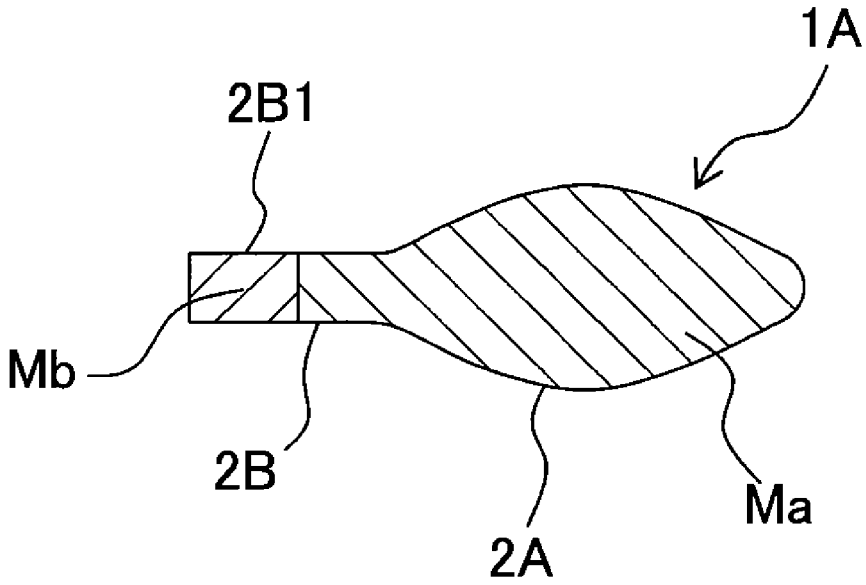
Figure 1B:
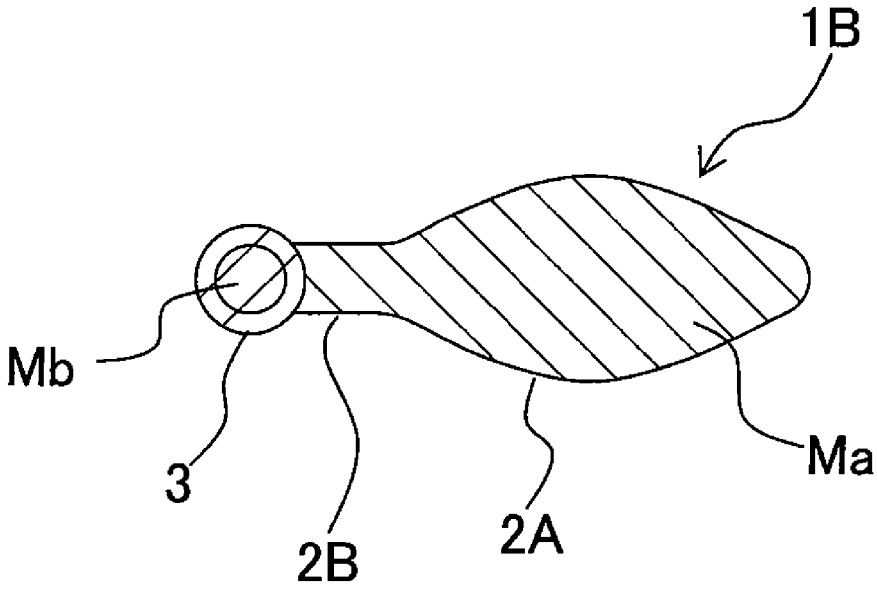
Figure 2B:
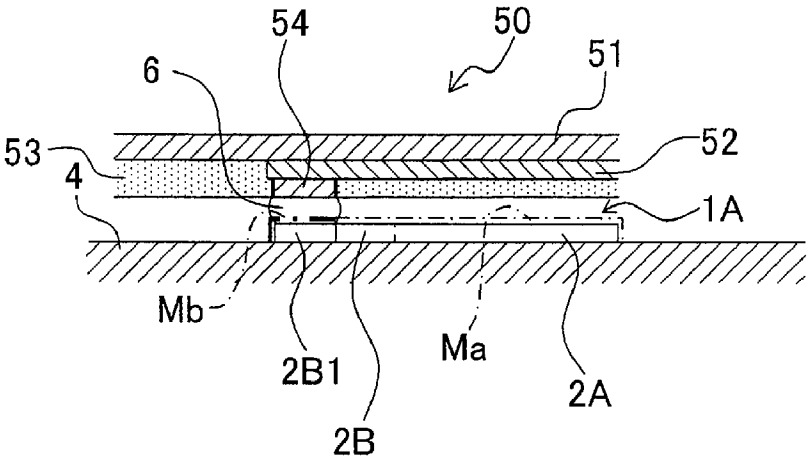
Figure 2A:
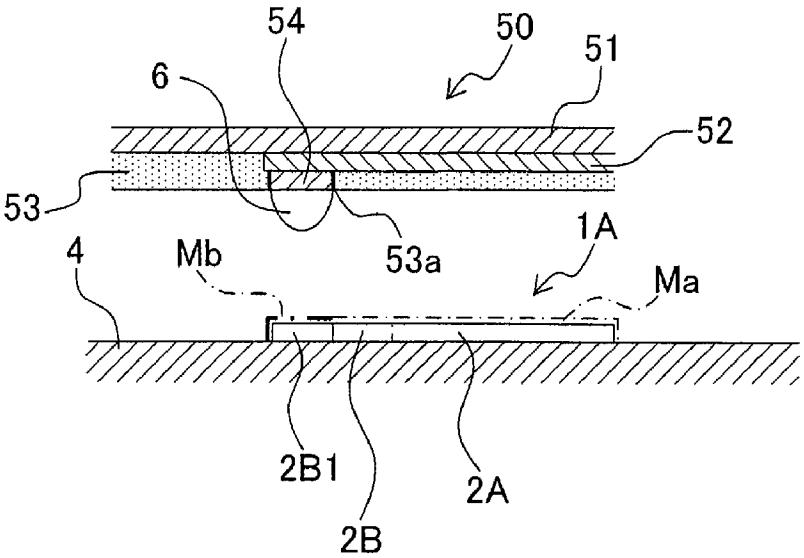
Figure 3B:
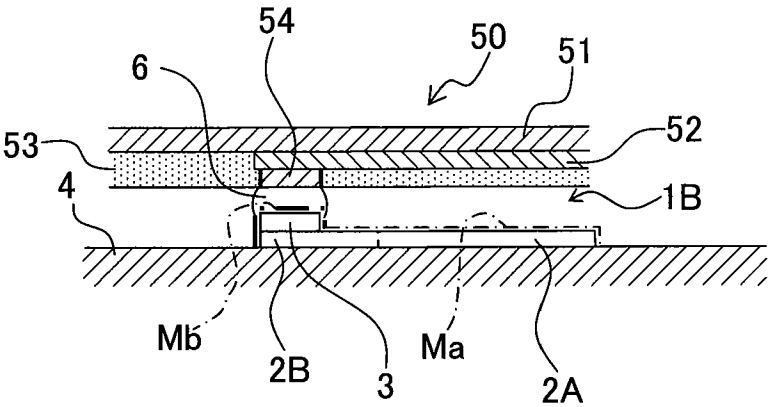
Figure 3A:
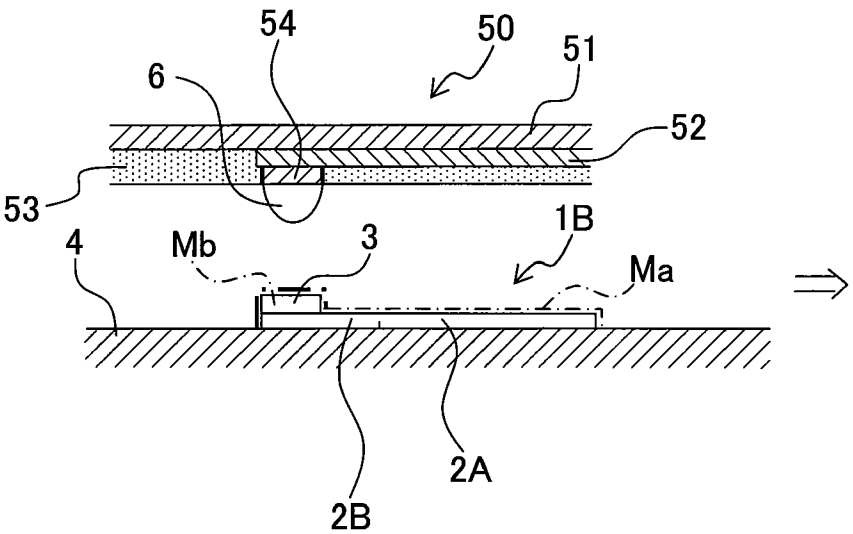

FIG. 1 shows magnified plan views illustrating individual electrodes according to the present invention, wherein FIG. 1A shows the individual electrodes 1A of a first embodiment, and FIG. 1B shows the individual electrodes 1B of the second embodiment. FIGS. 2A, 2B and FIGS. 3A, 3B show the step of joining the individual electrode 1 and a circuit board or wired board 50 in each the embodiments. FIGS. 2A and 3A show the state before the joining, and FIGS. 2B and 3B show the state after the joining.

As shown in FIGS. 1A to 3B, the plurality of individual electrodes (surface electrodes, individual surface electrodes) 1 (1A and 1B) are arranged on a surface of a discharge driving element 4 (for example, a piezoelectric type actuator) of a discharge head. The individual electrodes 1 (1A and 1B) are electrically connected to the discharge driving element 4. The individual electrodes 1A, 1B are electrically connected to a plurality of connecting terminals 54 of the wired board 50 such as a flexible wiring member formed with a plurality of wiring patterns 52 for transmitting, for example, the driving signal and the control signal supplied from the apparatus such as a printer. The voltage for driving the discharge driving element 4 is applied thereto.

As shown in FIGS. 1A and 1B, each of the individual electrodes 1A, 1B comprises a main electrode section 2A which has a substantially rhombic or lozenge-shaped form as viewed in a plan view, and a subsidiary electrode section 2B which has a slender form and which is led on the left side from one acute angle portion disposed on the left side of the main electrode section 2A. The main electrode section 2A is provided corresponding to each of the driving areas to which the driving voltage is applied in order to drive the discharge driving element 4, on the surface of the discharge driving element 4. The subsidiary electrode section 2B is formed to extend at the position deviated from each of the driving areas.

Any one of the individual electrodes 1A, 1B is formed of a silver electrode based on, for example, the Ag—Pd system or the Ag—Pt system.

In the first embodiment, as shown in FIGS. 1A and 2A, a connecting section 2B1, which is provided to make the connection with respect to the terminal 54 of the wired board 50, is formed at the position of the subsidiary electrode section 2B deviated toward the end on the side (left side) opposite to the side of the main electrode section 2A. The connecting section 2B1 is a part of the subsidiary electrode section 2B. A gold coating Mb is applied to the surface of the connecting section 2B1, i.e., to the upper surface (surface opposed to the terminal) and the side surfaces. The connecting section 2B1, to which the gold coating Mb is applied, is connected to a bump of a conductive brazing material 6 arranged on the terminal 54. A silver sulfide ($Ag_2S$) coating Ma is formed on the surface of the portion (including the upper surface (surface opposed to the terminal) and the side surfaces) except for the connecting section 2B1 to which the gold coating Mb is applied, of the surface of the individual electrodes 1A (including the upper surface and the respective side surfaces).

In the second embodiment, as shown in FIGS. 1B and 3A, a connecting electrode section 3, which is formed to make the connection with respect to the terminal 54 of the wired board 50, is provided at the position deviated toward the end on the side (left side) opposite to the side of the main electrode section 2A, on the subsidiary electrode section 2B. The connecting electrode section 3 has a substantially circular form as viewed in a plan view, which is formed of a silver electrode material based on, for example, the Ag—Pd system. A gold coating Mb is applied to the surface of the connecting electrode section 3 (including the upper surface and the respective side surfaces). A silver sulfide coating Ma is applied to the surfaces (including the upper surfaces and the respective side surfaces) of the subsidiary electrode section 2B and the main electrode section 2A of the individual electrode 1B except for the connecting electrode section 3, of the surface of the individual electrode 1B.

The wired board 50 includes a base film 51, a plurality of wiring patterns 52 which are formed on the lower surface of the base film 51, and a cover film 52 which covers the substantially entire lower surface of the base film 51. Further, the wired board 50 has a driver IC 80 which applies the driving signal to the discharge driving element 4 as described later on.

A plurality of through-holes 53*a* are formed at positions of the cover film 53 opposed to the plurality of connecting sections 2B1 or the plurality of connecting electrode sections 3 so that parts of the wiring pattern 52 are exposed to the side of the individual electrodes 1A. The plurality of connecting terminals 54 are provided on the wiring pattern 52 via the through-holes 53*a*. The connecting terminals 54 and the connecting sections 2B1 or the connecting electrode sections 3 are arranged opposingly to one another.

The bump of the conductive brazing material (for example, solder) 6 is arranged on each of the connecting terminals 54 to make the joining or junction with respect to the connecting sections 2B1 or the connecting electrode sections 3 of the individual electrodes 1. Therefore, the connecting sections 2B1 (or the connecting electrode sections 3) are joined to the connecting terminals 54 corresponding thereto, by means of the conductive brazing material 6. Accordingly, the both are connected mechanically and electrically. Therefore, it is possible to transmit the driving signal to the discharge driving element 4 via the driver IC 80. In this embodiment, the solder 6 is used as an example of the conductive brazing material 6. The following description will be made assuming that the conductive brazing material 6 is the solder 6.

Any one of the base film 51 and the cover film 53 is an insulative sheet member. In this embodiment, the base film 51 is composed of a polyimide resin, and the cover film 53 is composed of a photosensitive material. When the cover film 53 is composed of the photosensitive material as described above, it is easy to form the large number of through-holes 53*a*. The wiring pattern 52 is formed of a copper foil. The wiring pattern 52 forms a predetermined pattern on the lower surface of the base film 51. The base film 51 has a thickness of about 25 μm, the wiring pattern 52 has a thickness of about 9 μm, and the cover film 53 has a thickness of about 20 μm.

The terminals 54 are composed of, for example, a conductive material such as nickel. The terminals 54 close the through-holes 53*a*, and the terminals 54 cover the outer circumferential edge of the through-holes 53*a* on the lower surface of the cover film 53. The terminals 54 are formed on the side of the individual electrodes 1, of the cover film 53. The diameter of the terminals 54 is about 50 μm, and the thickness of the cover film 52 from the lower surface is about 30 μm. It is also allowable that the terminals 54 are a part of the wiring pattern 52 exposed from the through-holes 53*a* which are open on the cover film 53. The bumps of the solder 6 are arranged on the terminals 54. The terminals 54 and the connecting sections 2B1 (or the connecting electrode sections 3) are positioned while allowing them to correspond to one another. The wired board 50 and the discharge driving element 4 are stacked. An unillustrated heater or the like is pressurized and heated from the side of the base film 51 of the wired board 50. Accordingly, the solder 6 can be arranged to range over the area interposed between the terminal 54 and the connecting section 2B1. The wired board 50 and the discharge driving element 4 can be connected to one another electrically and mechanically at the predetermined joining position.

When the wired board 50 and the discharge driving element 4 are positioned closely to one another to arrive at the predetermined joining position, if the amount of the brazing material is small, then it is feared that any electric or mechanical connection deficiency may be caused. If the amount of the brazing material is too large, it is feared that the solder 6 may leak to the surroundings of the connecting terminals 54 and the connecting sections 2B1 (connecting electrode sections 3). If the solder 6 leaks to the main electrode sections 2A, and the solder 6 adheres thereto, then problems consequently arise such that the driving operation of the driving areas of the driving element is inhibited by the leaked solder 6 in some cases, and the connecting sections 2B1 (connecting electrode sections 3) form any short circuit between the adjoining individual electrodes in other cases. Therefore, it is desirable that the solder 6 is joined to only the predetermined areas of the connecting sections 2B1 and the connecting electrode sections 3 to serve as the connecting portions with respect to the wired board 50.

In view of the above, in the first embodiment, the gold coating Mb is formed on the surface of each of the predetermined areas (connecting sections 2B1) of the subsidiary electrode sections 2B to serve as the joining portion to make the connection with respect to the terminal 54 of the wired board 50. The silver sulfide coating Ma is formed on the surfaces of the main electrode sections 2A and the subsidiary electrode sections 2B other than the connecting sections 2B1. Also in the second embodiment, the connecting electrode sections 3 are formed on the surfaces of the predetermined areas of the subsidiary electrode sections 2B in the same manner as described above. Further, the gold coating Mb is formed on each of the surfaces thereof, and the silver sulfide coating Ma is formed on each of the surfaces of the main electrode sections 2A and the subsidiary electrode sections 2B other than the connecting electrode sections 3.

In general, gold is a metal which is excellent in the conductivity and which is excellent in the wettability (affinity, easiness to apply the solder) with respect to the solder 6. Owing to the fact that the connecting sections 2B1 and the connecting electrode sections 3 are subjected to the gold coating, the connecting sections 2B1 and the connecting electrode sections 3 can be electrically and mechanically connected and joined to the terminals 54 of the wired board 50 by the aid of the solder 6. Further, gold is a metal which is hardly sulfurized. Therefore, the gold coating surface is maintained without being sulfurized in the sulfurizing step of the formation on the surface other than the connecting sections 2B1 and the connecting electrode sections 3 in order to form the silver sulfide coating Ma as explained later on. Therefore, it is possible to work as the connecting portions with respect to the terminals 54 of the individual electrodes 1.

It is also allowable that the metal, which is to be used for the coating Mb, is not necessarily gold provided that the metal is satisfactory in the conductivity, the metal has good wettability with respect to the conductive brazing material 6, and the metal is hardly sulfurized. Other than gold, it is also allowable to adopt, for example, palladium, rhodium, indium, and various alloys of these metals.

It is known that silver sulfide ($Ag_2S$) is a metal sulfide which is an insulator and which has bad wettability with respect to the solder 6. For example, the following problem is described, for example, in Japanese Patent Application Laid-open No. 09-298018. That is, plating silver is changed to silver sulfide in the solder connection between a printed circuit board and a connecting terminal on which the plating silver is formed. As a result, the wettability with respect to the solder is deteriorated, and it is impossible to form any solder bridge between the connecting terminal and the printed circuit board, although the connecting characteristic is unchanged. In "Characteristic of Pd Plating Electric Contact" described on pages 46 to 50 of Furukawa Review No. 106

(July 2000), it is also described that the deterioration of the solder wettability is exhibited when a plating of silver sulfide is applied. In this embodiment, the low affinity of silver sulfide for the solder 6 as described above, i.e., the low wettability is utilized. Further, silver is poor in the sulfurization resistance. Therefore, silver is bonded to any sulfur component such as sulfur dioxide and hydrogen sulfide contained in the atmospheric air, and silver sulfide is easily produced thereby. Therefore, it is possible to produce silver sulfide extremely easily. In Japanese Patent Application Laid-open No. 2007-12908, it is also described that even when a silver electrode is covered with a plating or the like, then the silver electrode is corroded easily by any sulfur component such as hydrogen sulfide contained in the atmospheric air, and silver sulfide is consequently produced. In other words, in this embodiment, silver sulfide can be easily produced, because silver is used as the material for the surface electrode of the individual electrode. For the reasons as described above, when the solder 6 is used as the conductive brazing material, the silver sulfide coating, which deteriorates the wettability with respect to the solder, is applied to the surface other than the connecting section 2B1 or the connecting electrode section 3, of the surface of the individual electrode 1 which is the silver electrode.

In the first and second embodiments, the connecting sections 2B1 or the connecting electrode sections 3 are formed on the surfaces of the part of the individual electrodes 1A, 1B, and the gold coating Mb is formed thereon. The connecting portions can be formed on the surface of the individual electrodes 1A, and the gold coating Mb is hardly sulfurized. Therefore, even when any sulfurizing step is included in the following steps, it is possible to maintain the gold surfaces as the connecting portions. Therefore, it is possible to effect the electric and mechanical connection and joining by means of the conductive brazing material. In the first embodiment, the connecting electrode sections 2B1 are formed on the same surfaces of the part of the individual electrodes 1A, and the gold coating Mb is applied thereto. Therefore, it is unnecessary to distinctly provide any connecting terminal.

The silver sulfide coating Ma is formed on the portion except for the gold coating Mb, of the surface of each of the individual electrodes 1A. Even when the conductive brazing material leaks from the areas interposed by the terminals 54 and the connecting sections 2B1 (connecting electrode sections 3), the conductive brazing material does not leak to the main electrode sections 2A provided on the discharge driving areas. There is no fear of adhesion of any excessive conductive brazing material to any portion of the discharge head except for the desired joining portion. Therefore, it is possible to avoid any harmful influence including, for example, the electric disconnection and the short circuit formation which would be otherwise caused by the leaked conductive brazing material.

In the embodiments described above, the gold coating Mb is formed on the upper surfaces and the side surfaces of the connecting sections 2B1 and the connecting electrode sections 3. However, on condition that the gold coating Mb is formed on at least one surface disposed on the upper side opposed to the terminals 54 of the wired board 50, it is possible to effect the electric and mechanical connection and joining by the aid of the solder 6 while being opposed to the terminals 54. Similarly, on condition that the silver sulfide coating Ma is formed at least on the surface disposed on the upper side opposed to the terminals 54 of the wired board 50, of the surface of the individual electrodes 1A, 1B, it is possible to avoid the leakage of the solder 6 to the driving areas.

In the embodiments described above, the silver sulfide coating Ma is formed on the entire surfaces of the individual electrodes except for the desired connecting areas. In this arrangement, it is enough that the solder 6 does not leak to the main electrode sections 2A confronted with the driving areas. Therefore, it is possible to provide the effect to dam up or intercept the leakage of the solder 6 by merely providing the silver sulfide coating Ma partially in the areas disposed in the vicinity of the connecting sections 2B1 (connecting electrode section 3) between the connecting sections 2B1 (connecting electrode section 3) and the main electrode sections 2A on the upper surface of the individual electrodes.

Figure 4A:
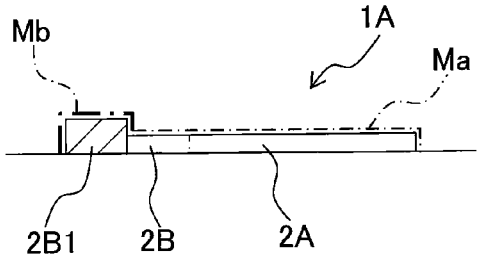

FIG. 4A shows a first modified embodiment concerning the first embodiment. In this way, a connecting section 2B1 of each of the individual electrodes 1A may be formed to protrude upwardly. In this arrangement, when the gold coating is applied to at least to a part of the upper surface of the protruding connecting section 2B1, it is possible to join the connecting section 2B1 and the conductive brazing material.

Figure 4B:
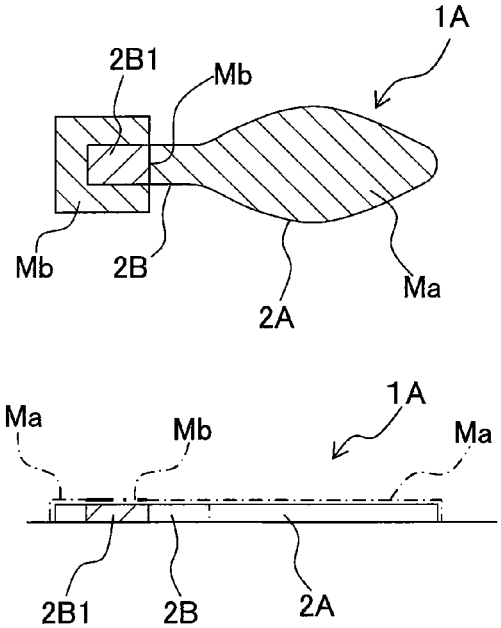
Figure 4C:
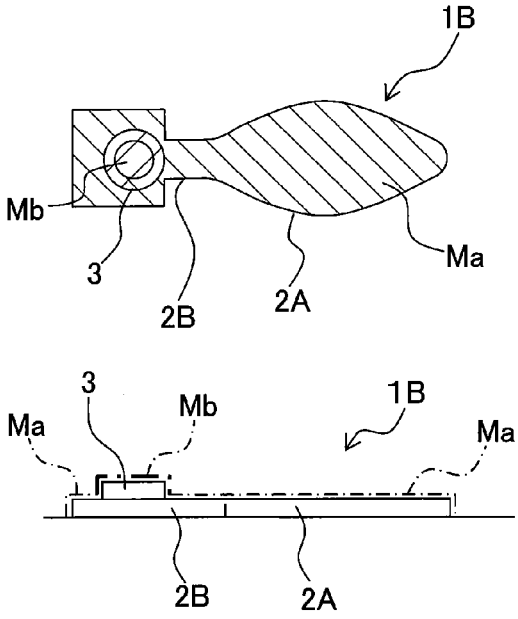

In the first and second embodiments, the connecting section 2B1 and the connecting electrode section 3 are formed at the left ends of the subsidiary electrode sections 2B. In this arrangement, as shown in FIG. 4B, the left end of each of the subsidiary electrode sections 2B having the slender shape may be formed to have a wide width as compared with the connecting sections 2B1 (second modified embodiment). Similarly, as shown in FIG. 4C, the left end of each of the subsidiary electrode sections 2B having the slender shape may be formed to have a wide width as compared with the connecting electrode sections 3 (third modified embodiment). In any case, the silver sulfide coating Ma is formed on the left end which is formed to have the wide width. Therefore, the connecting sections 2B1 and the connecting electrode sections 3 are in such a state that the entire surroundings thereof are surrounded by the area of the silver sulfide coating Ma as viewed in a plan view. Therefore, the solder, which may cause the leakage, can be prevented from the leakage toward the entire surroundings without being limited to only the leakage toward the side of the main electrode sections 2A. Therefore, it is possible to retain the solder in only the areas of the connecting portions. Alternatively, for example, a plurality of slits and/or protrusions may be formed for the solder leakage to surround the connecting sections 2B1 and the connecting electrode sections 3 of the individual electrodes 1.

The gold coating Mb is formed on the surface of the connecting sections 2B1 or the connecting electrode sections 3. However, it is not necessarily indispensable to provide the coating. Any connecting sections 2B1 or any connecting electrode sections 3, which are formed of a metal such as gold having the satisfactory conductivity and the good wettability with respect to the solder, the metal being hardly sulfurized as described above, or which are formed of a mixture or a composite containing the metal as described above, may be formed on the individual electrodes 1A, 1B or at any portions disposed closely thereto. Also in this case, gold or the like, which exhibits the good wettability with respect to the solder and which is hardly sulfurized, is exposed on the surfaces opposed to the terminals 54. Therefore, it is possible to provide the effect which is the same as or equivalent to that obtained when the coating Mb is formed as described above. For example, a gold material containing glass flit or gold itself may be arranged adjacently on the subsidiary electrode sections 2B of the individual electrodes 1A, 1B, or such a material may be arranged on the subsidiary electrode sections 2B as the connecting electrode sections 3. It goes without saying that the connecting sections 2B1 or the connecting electrode sections 3, which are formed as described above, are electrically connected to the individual electrodes 1A, 1B.

Figure 11:
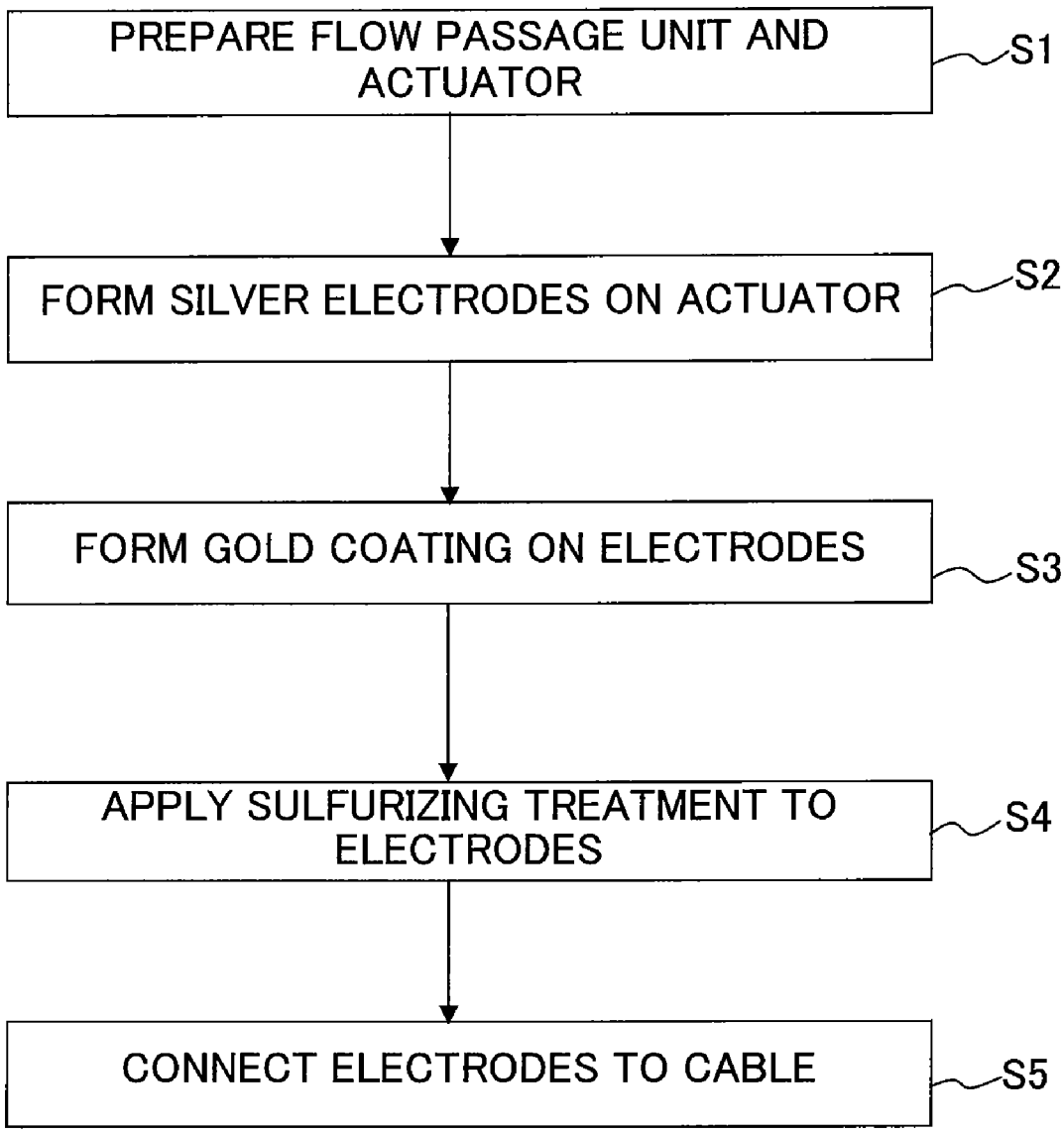
FIG. 11 shows a flowchart explaining a method for producing the electrodes.

Next, an explanation will be made about the steps of forming the gold coating Mb and the silver sulfide coating Ma on the individual electrodes 1A, 1B with reference to a flow chart shown in FIG. 11.

The individual electrode 1A, 1B is formed such that a metal mask is previously arranged on the discharge driving element 4 to print the silver electrode (S1). After that, the masking is applied, for example, with a resin film equipped with an adhesive layer to the portions except for the portions to be formed into the connecting sections 2B or the connecting electrode sections 3, of the entire surface of the individual electrodes 1A, 1B. The gold coating Mb is formed on the portions to be formed into the connecting sections 2B1 or the connecting electrode sections 3 by means of the gold vapor deposition or any general plating treatment method such as the electric gold plating or the electroless gold plating (S2). The connecting electrode sections 3 are previously joined onto the individual electrode sections 1B. When the connecting sections 2B and the connecting electrode sections 3 are formed for the individual electrodes 1A, 1B with gold or any mixture containing gold including, for example, gold containing glass flit, it is possible to form the connecting sections 2B and the connecting electrode sections 3 by performing the mask printing.

The discharge driving element 4, which is provided after the step of the gold coating Mb, is placed in a hydrogen sulfide atmosphere to perform the sulfurizing treatment for the individual electrodes 1A, 1B (S3). In this procedure, the individual electrodes 1A, 1B are formed with the silver which is easily sulfurized. Therefore, the silver sulfide coating Ma is formed on the portions of the surface of the individual electrodes 1A, 1B except for the connecting sections 2B or the connecting electrode sections 3 formed of the simple substance of gold or the mixture containing gold or the coating with gold to be hardly sulfurized. However, the connecting sections 2B1 or the connecting electrode sections 3, which are formed of the simple substance of gold or the mixture containing gold or the gold coating, are not sulfurized. It is possible to maintain the surface (including the upper surface and the side surfaces) containing gold or the gold coating surface Mb as it is. In this way, the connecting sections 2B1 or the connecting electrode sections 3 containing gold or the gold coating portions and the electrode sections applied with the silver sulfide coating can be integrally formed on the surfaces of the individual electrodes 1A, 1B.

The film thickness of the gold coating was about 0.01 to 0.1 μm, and the film thickness of the silver sulfide coating was about 0.2 to 0.3 μm. The gold coating having the thickness of about 0.01 to 0.1 μm can be easily formed by means of any general plating treatment. The silver sulfide coating having the thickness of about 0.2 to 0.3 μm can be easily formed by means of the sulfurization treatment in which the material is immersed in a sulfurizing solution or sulfurizing gas. In this embodiment, those used as gold include general pure gold and gold alloy added, for example, with a small amount of nickel and/or cobalt. However, for example, the content and the composite thereof are appropriately adjusted, and the film thickness thereof is adjusted to perform the production.

In the sulfurizing treatment, for example, the material is exposed for a predetermined period of time (for example, 3 hours) in a hydrogen sulfide atmosphere at a concentration of 3 ppm. When the sulfurizing treatment is performed, it is possible to form the silver sulfide coating of about 0.2 to 0.3 μm on the silver electrode surface. The gold coating portions Mb formed on the connecting sections 2B1 or the connecting electrode sections 3 as the silver electrode do not cause the sulfurizing reaction even when the sulfurizing treatment is performed. Similarly, the connecting sections 2B1 or the connecting electrode sections 3 formed while containing gold do not cause the sulfurizing reaction even when the sulfurizing treatment is performed. It is also allowable that the sulfurizing treatment is performed in an atmosphere of sulfur dioxide other than hydrogen sulfide.

In other words, it is possible to easily produce the silver sulfide coating, on the surface of the individual electrodes other than the connecting portion, and the connecting portions as formed while containing gold or the gold coating Mb, by merely exposing, in the hydrogen sulfide atmosphere for the predetermined period of time, the individual electrodes formed with the connecting portions previously formed while containing gold or the gold coating Mb at the desired connecting portions. Therefore, it is possible to integrally form the areas which are excellent in the solder wettability and the areas which are defective in the solder wettability. It is noted that the connecting portion containing gold or the gold coating is excellent in the wettability with respect to the solder. Therefore, it is possible to form the connecting electrode sections which is easily joined mechanically and electrically.

It is enough that the gold coating Mb and the silver sulfide coating Ma are formed on at least a part of the side (upper side) opposed to the terminals on the surfaces of the individual electrodes. In this case, the following procedure is available. That is, the surfaces of the individual electrodes, or the surfaces of the connecting sections or the connecting electrode sections are previously masked before the sulfurizing treatment by using, for example, the metal mask or the resin film equipped with the adhesive layer to perform the sulfurizing treatment. The method for joining the individual electrodes 1 (1A, 1B) formed as described above and the wired board 50 will be explained with reference to FIGS. 2A to 3B.

In the first embodiment, as shown in FIG. 2A, the terminals 54 of the wired board 50 are previously formed at the positions opposed to the connecting sections 2B1. The bumps of the solder 6 are formed on the terminals 54. The positional adjustment is performed so that the connecting sections 2B1 formed with the gold coating Mb are joined to the bumps, and the wired board 50 is stacked and arranged on the discharge driving element 4. The heating (pressurization) is performed with an unillustrated heater from the position over or above the wired board 50. As shown in FIG. 2B, the solder 6, which ranges over between the connecting terminals 54 and the connecting sections 2B1, is adhered to and retained in only the predetermined areas formed with the gold coating Mb having the wettability with respect to the solder. In this way, the connecting terminals 54 and the connecting sections 2B1 are joined to one another. In this procedure, it is feared that the solder 6 may flow out from the areas interposed between the both depending on the pressurization by the heater and/or the amount of the solder 6. However, there is no fear of adhesion of the solder 6 in the areas formed with the silver sulfide coating Ma, because there is no wettability with respect to the solder 6. Therefore, the solder 6 does not leak onto the main electrode sections 2A on which the silver sulfide coating Ma is formed. When the gold coating Mb and the silver sulfide coating Ma are formed not only on the upper surfaces opposed to the terminals but also on the side surfaces, it is possible to prevent the solder from causing the wetting and the spread with respect to the adjoining individual electrodes 1A while reliably securing the electric and mechanical connection with respect to the terminals.

Also in the second embodiment, as shown in FIG. 3A, the bumps of the solder 6 are adhered to the terminal sections 54 exposed to the outside of the wired board 50 provided with the base film 51, the wiring pattern 52, the cover film 53 as the insulating film, and the terminals 54 in the same manner as in the first embodiment, to effect the joining to the connecting electrode sections 3 formed with the gold coating Mb.

Accordingly, as shown in FIG. 3B, the solder 6 is adhered and joined to the connecting electrode sections 3 formed with the gold coating Mb. The solder 6 is not adhered to the areas in which the silver sulfide coating Ma is formed, because the wettability for the solder 6 is absent. Therefore, the joined state is given, in which the solder 6 does not leak onto the main electrode sections 2A formed with the silver sulfide coating Ma. Also in the second embodiment, the gold coating Mb and the silver sulfide coating Ma are formed not only on the upper surfaces opposed to the terminals but also on the side surfaces. Therefore, the effect, which is the same as or equivalent to that obtained in the first embodiment, is obtained.

As described above, the gold coating is previously formed on the connecting section and the connecting electrode section, and the silver sulfide coating is formed beforehand on the electrode sections on which it is intended to suppress the adhesion of the conductive brazing material, before the joining is performed by using the conductive brazing material such as the solder between the terminals and the connecting sections and between the terminals and the connecting electrode sections. In this procedure, it is possible to reliably join the solder to the connecting section, and it is possible to prevent the solder from any leakage to any area other than the connecting sections. Accordingly, any excessive solder is not allowed to outflow and be retained at the main electrode sections of the individual electrodes as the driving areas of the discharge driving element 4. Therefore, the operation of the driving areas is not inhibited or obstructed by the leaked solder. There is no fear of the occurrence of the wire disconnection and the short circuit formation as well.

The discharge head, which is provided with the electrodes as described above, can be appropriately applied to the liquid droplet discharge head having the discharge driving element based on the use of the piezoelectric type actuator.

An explanation will be made below about an ink-jet printer in which the discharge head according to the present invention is applied to the ink-jet head H. The ink-jet head H is constructed in the same manner as an ink-jet head described in Japanese Patent Application Laid-open No. 2004-136663. A discharge driving element 4 of the ink-jet head described in Japanese Patent Application Laid-open No. 2004-136663 is explained as the actuator unit 21 in this application. An individual electrode 1 and a wired board 50 of the ink-jet head described in Japanese Patent Application Laid-open No. 2004-136663 are constructed in the same manner as the individual electrodes 1 and the wired board 50 of the ink-jet head H of this application. Therefore, the explanation of Japanese Patent Application Laid-open No. 2004-136663 is incorporated herein by reference.

In the following description, the direction, in which the ink-jet head H makes the reciprocating movement, is designated as the main or primary scanning direction, and the direction, which is perpendicular thereto, is designated as the subsidiary or secondary scanning direction. The side, on which the nozzles of the ink-jet head H are formed, is designated as the lower side (downward direction). The opposite side is designated as the upper side (upward direction). The left-right direction is defined by the left-right direction as depicted in each of the drawings.

Figure 5A:
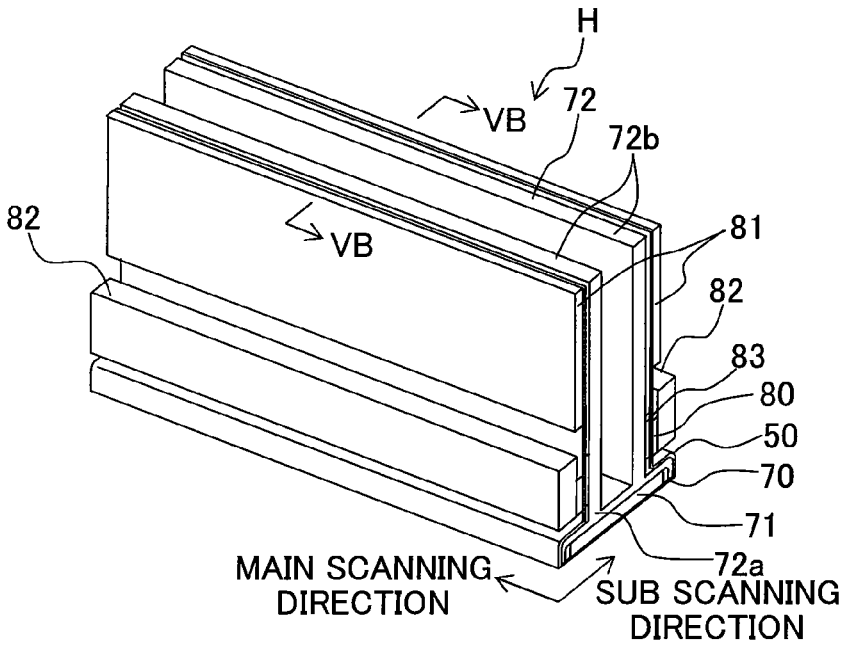
Figure 5B:
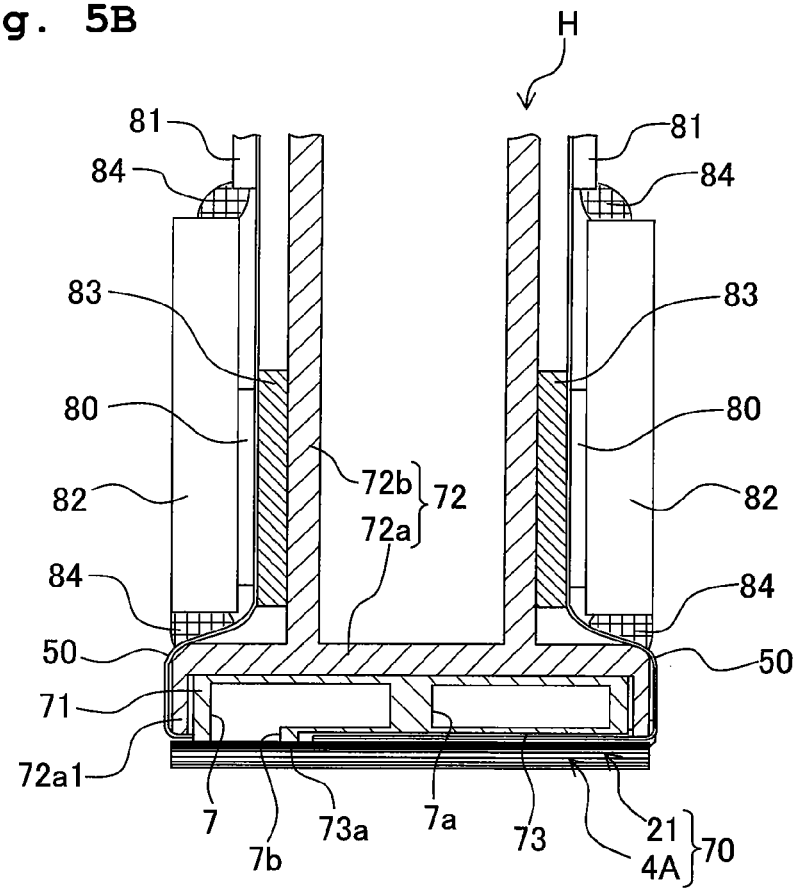

FIG. 5 shows the ink-jet head H. FIG. 5A shows a perspective view illustrating the ink-jet head H, and FIG. 5B shows a sectional view taking along a line VB-VB thereof. As shown in the drawings, the ink-jet head H of this embodiment has a rectangular shape as viewed in a plan view extending in the main scanning direction. The ink-jet head H comprises a main head body 70 which is provided with a plurality of nozzles (see FIG. 7) for discharging the ink with respect to the printing paper, and a base block 71 which is arranged over or above the main head body 70 and which is partially adhered thereto. The upper surface of base block 71 to which the main head body 70 is attached is adhered and retained by a holder 72.

The main head body 70 has a substantially oblong shape as viewed in a plan view which is elongated in the main scanning direction. The main head body 70 comprises a flow passage unit 4A which is formed with ink flow passages, and a plurality of actuator units 21 which are adhered to the upper surface of the flow passage unit 4A. Flexible wired boards 50 are joined to the upper surfaces of the actuator units 21, wherein the both ends thereof are led from the both sides in the transverse direction of the main head body 70. Driver IC's are mounted on the respective wired boards 50 led to the both sides respectively to make the electric connection in order that the driving signal, which is outputted from the driver IC 80, is transmitted to the actuator unit 21 of the main head body 70. The base block 71 is composed of a metal material including, for example, stainless steel. The base block 71 has a substantially rectangular parallelepiped shape having approximately the same length as the length of the main head body 70 in the longitudinal direction. Two ink pools 7, which are two hollow areas having substantially rectangular parallelepiped shapes to extend in the longitudinal direction, are formed with a partition wall 7*a* intervening therebetween, as the flow passages for the ink to be supplied to the main head body 70, in the base block 71. The ink pools 7 are provided in parallel to one another while being separated from each other by a predetermined spacing distance in the longitudinal direction of the base block 71. Openings 7*b*, which are communicated with the ink pools 7, are formed at the positions which correspond to the ink pools 7 and which are disposed on the left side of the lower surface 73 of the base block 71 as shown in FIG. 5B. The ink pool 7 is connected via a supply tube (not shown) to an ink tank (not shown) included in the main printer body. Therefore, the ink pool 7 is appropriately supplemented with the ink from the ink tank.

The both ends of a gripping section 72*a* of the holder 72 form skirt sections 72*a*1 which extend on the lower surface. The base block 71 is adhered and fixed in a recess formed by the skirt sections 72*a*1. The holder 72 has the gripping section 72*a*, and a pair of flat plate-shaped protruding sections 72*b* which are allowed to extend from the upper surface of the gripping section 72*a* in the direction perpendicular thereto while providing a predetermined spacing distance. Each of the pair of protruding sections 72*b* is a flat plate-shaped member. The protruding sections 72*b* are provided in parallel to one another while providing the predetermined spacing distance in the longitudinal direction of the gripping section 72*a*. Each of the wired boards 50 is arranged and fixed so that each of the driver ICs 80 mounted on each of them extends along the surface of the protruding section 72*b* of the holder 72 by the aid of an elastic member 83 composed of sponge or the like. The end of each of the wired boards 50 is connected to a board 81. A heat sink 82 is installed to on the outer side of the driver IC 80. The heat, which is generated in the driver IC 80, is released thereby. Seal members 84 are installed between the upper surface of the heat sink 82 and the board 81 and between the lower surface of the heat sink 82 and the wired board 50 respectively. The driver IC 80 receives the control signal from an unillustrated control circuit disposed on the main body side, and the driving signal is transmitted to the actuator to selectively drive the actuator.

The lower surface 73 of the base block 71 protrudes in the downward direction as compared with the surroundings in the vicinity of the opening 7*b* of the ink pool 7. The base block 71 makes contact with the flow passage unit 4A at only the vicinity portion 73*a* of the opening 7*b* of the lower surface 73. Therefore, the area except for the vicinity portion 73*a* of the opening 7*b* of the lower surface 73 of the base block 71 is isolated from the main head body 70. The actuator unit 21 is arranged in the space formed therebetween.

An unillustrated seal member is arranged to interpose the wired board 50 between the upper surface of the flow passage unit 4 and the lower surface of the skirt section 72*a*1 of the main holder body 72. The wired board 50 is fixed by the seal member with respect to the flow passage unit 4 and the main holder body 72. Accordingly, it is possible to avoid any warpage of the main head body 70 even when the main head body 70 is lengthy, it is possible to avoid the application of any excessive stress to the connecting portion between the wired board 50 and the individual electrode (1A, 1B) (see FIGS. 1A and 1B) formed on the surface of the actuator unit, and it is possible to reliably retain the wired board 50.

Figure 6:
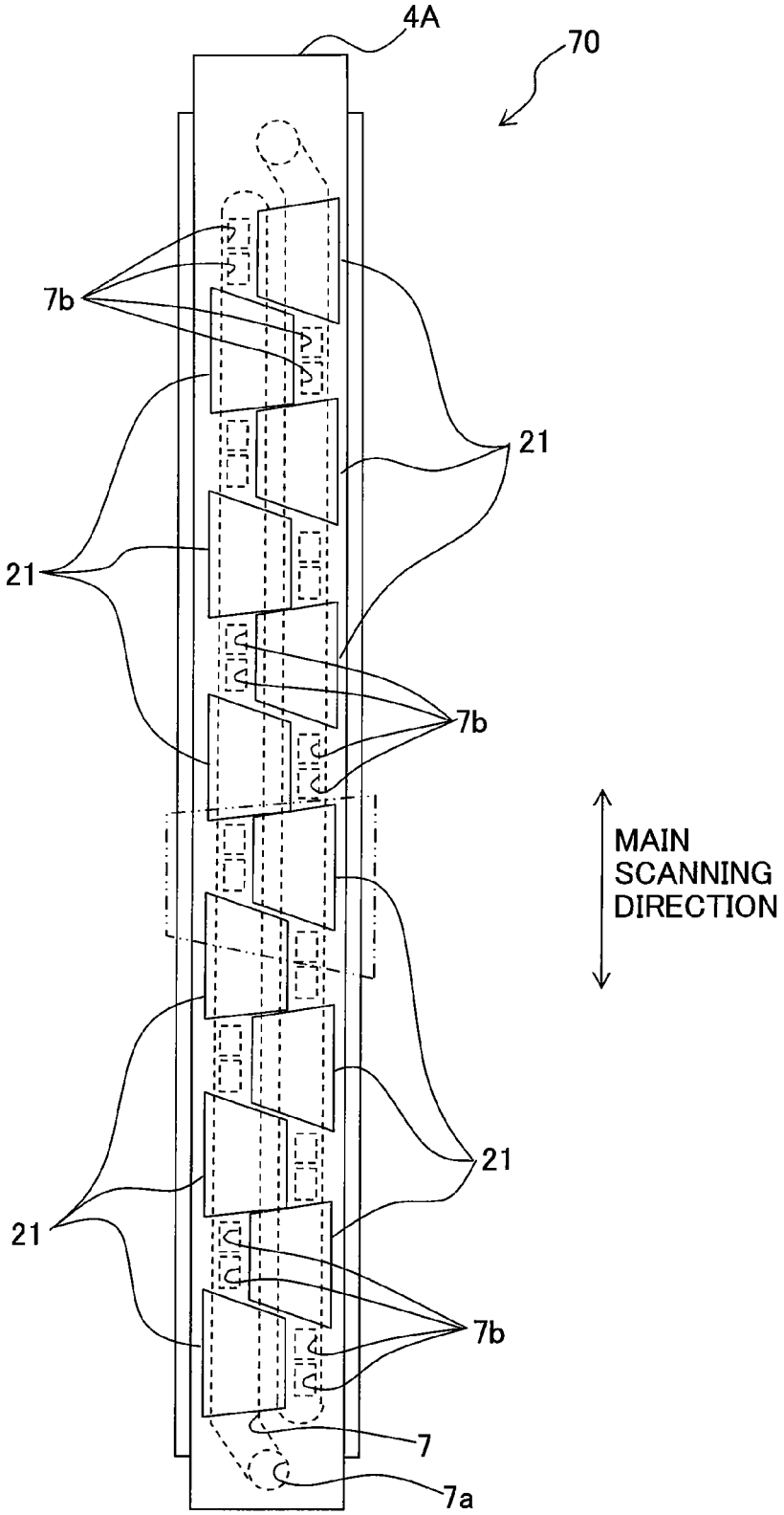
FIG. 6 shows a plan view illustrating a main head body 70 included in the ink-jet head H depicted in FIG. 4.

FIG. 6 shows a plan view illustrating the main head body 70 included in the ink-jet head H shown in FIG. 5, wherein the ink pools 7, which are formed in the base block 71, are imaginary depicted with broken lines. As shown in FIG. 6, the main head body 70 has a rectangular planar shape extending in one direction (main scanning direction). The main head body 70 has the flow passage unit 4A which is formed with a large number of pressure chambers 10 and ink discharge ports 8 disposed at the forward ends of the nozzles (see FIG. 9 for the both) as described later on. A plurality of the trapezoidal actuator units 21, which are arranged in two arrays in a zigzag form, are adhered to the upper surface of the main head body 70. The respective actuator units 21 are arranged so that their parallel opposing sides (upper sides and lower sides) are disposed along with the longitudinal direction of the flow passage unit 4A. Oblique sides of the adjoining actuator units 21 are overlapped with each other in the widthwise direction of the flow passage unit 4A.

The lower surface of the flow passage unit 4A, which corresponds to the adhered area of the actuator unit 21, is the ink discharge area. A large number of ink discharge ports 8 are arranged in a matrix form on the surface of the ink discharge area as described later on. The ink pools 7 are formed in the longitudinal direction in the base block 71 arranged over or above the flow passage unit 4A. The ink pool 7 is communicated with the ink tank (not shown) via the opening 7*b* provided at one end thereof, which is always filled with the ink. The plurality of openings 7*b*, which form the pairs each composed of two of them, are provided in the extending direction for the ink pool 7 in a zigzag form corresponding to the area in which the actuator unit 21 is not provided.

Figure 7:
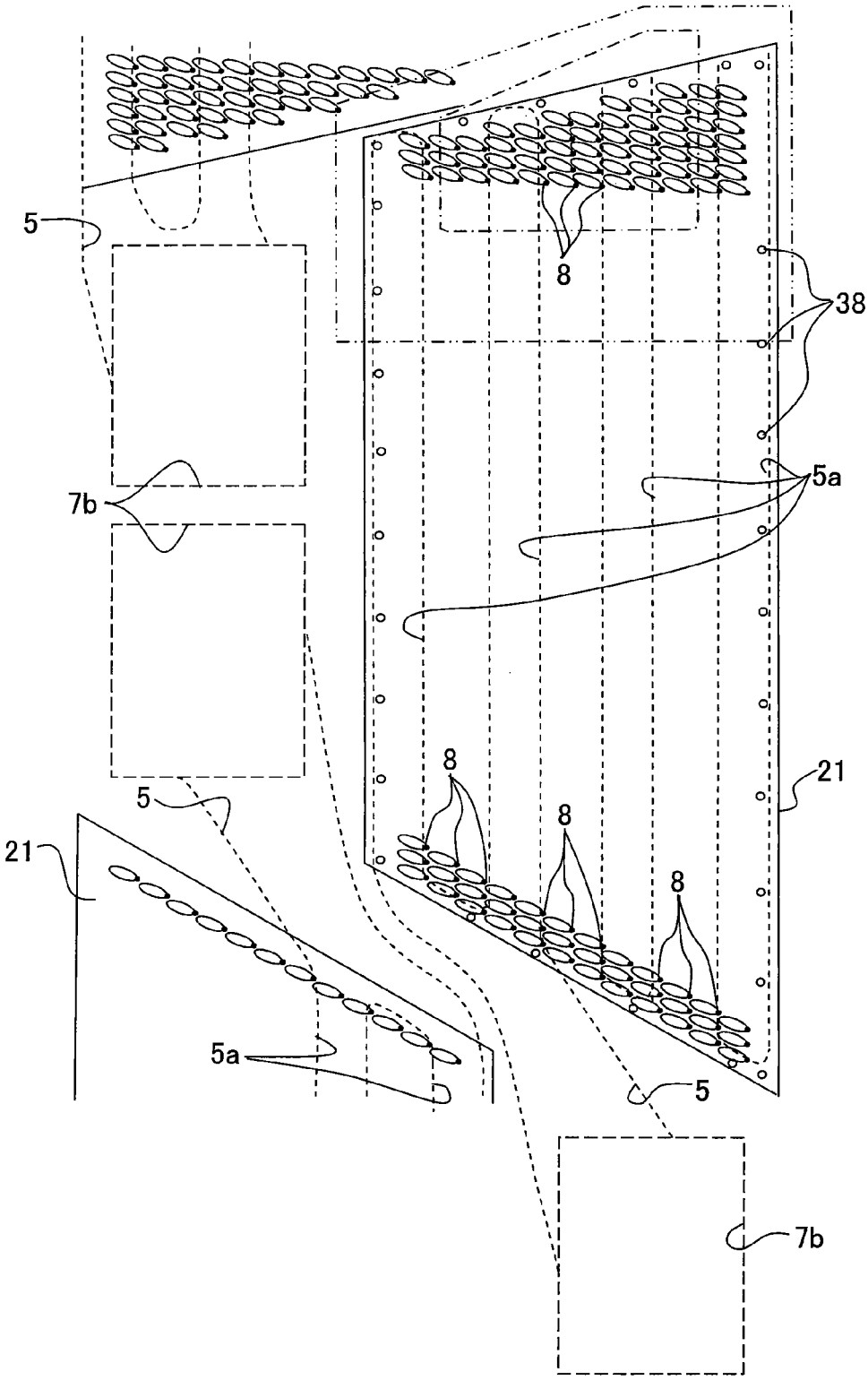
FIG. 7 shows a magnified view illustrating an area surrounded by one-dot chain lines depicted in FIG. 6.

FIG. 7 shows a magnified view illustrating the area surrounded by one-dot chain lines depicted in FIG. 6. As shown in FIGS. 6 and 7, the ink pool 7 is communicated with a manifold 5 (described later on) in the flow passage unit 4A disposed at the underlayer thereof via the opening 7*b*. The manifold 5 has its forward end which is branched into two to form subsidiary manifolds 5*a*. The two subsidiary manifolds 5*a* enter the lower portions of one actuator unit 21 respectively from the two openings 7*b* disposed at the both adjoining positions in the longitudinal direction of the ink-jet head H in relation to the concerning actuator unit 21. In other words, the four subsidiary manifolds 5*a* in total are allowed to extend in the longitudinal direction of the ink-jet head H under or below one actuator unit 21. The respective subsidiary manifolds 5*a* are filled with the ink supplied from the ink pool 7.

Next, the head unit will be explained.

Figure 8:
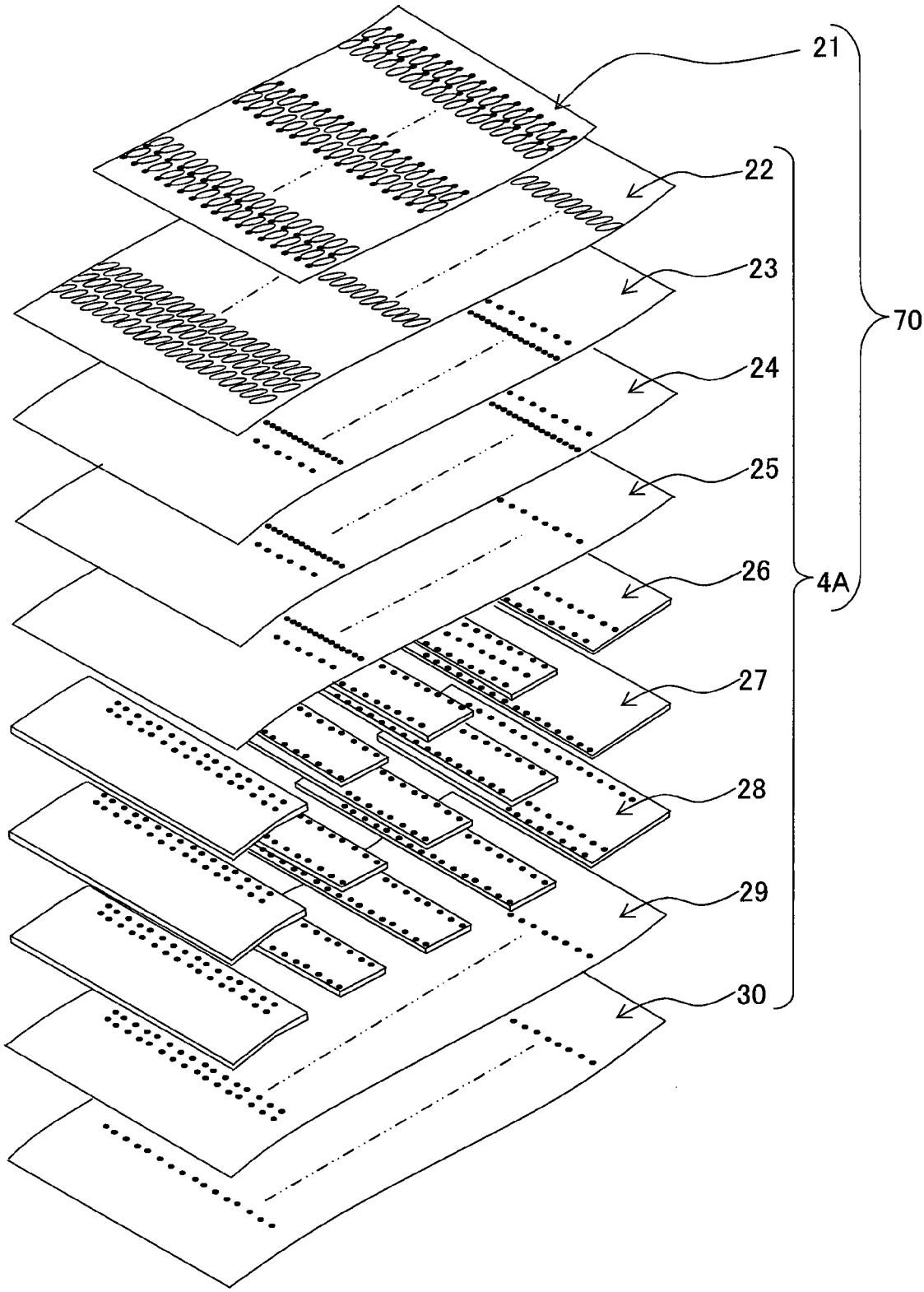
FIG. 8 shows a partial exploded perspective view illustrating the main head body.

As shown in FIG. 8, the main head body 70 has the stacked structure in which ten plates in total, i.e., the actuator unit 21, a cavity plate 22, a base plate 23, an aperture plate 24, a supply plate 25, three of manifold plates 26, 27, 28, a cover plate 29, and a nozzle plate 30 are stacked. The flow passage unit 4A is constructed by the nine plates except for the actuator unit 21. The actuator unit 21 has the four stacked piezoelectric sheets 41 to 44, for example, as shown in FIG. 10A. The electrodes are arranged while allowing the piezoelectric sheet 41 to intervene therebetween. In other words, only the piezoelectric sheet 41, which is disposed at the uppermost layer, is the layer which has the portion that serves as the active layer when the electric field is applied. On the other hand, the remaining three layers (piezoelectric sheets 42 to 44) serve as the inactive layers. In order to form the pressure chambers 10 as shown in FIG. 9, the base plate 23 and the cavity plate 22 as the metal plate provided with a large number of substantially rhombic openings as viewed in a plan view are arranged.

The cavity plate 22 of the flow passage unit 4A is the metal plate provided with a large number of substantially rhombic openings corresponding to the pressure chambers 10. The portions, which are not provided with the openings, form the wall sections 22*a* which compart the respective pressure chambers 10. The base plate 23 made of metal is formed with communication holes 23*a* which make the communication between the pressure chambers 10 and the apertures 12 respectively corresponding to the pressure chambers 10 of the cavity plate 22, and communication holes 23*b* which make the communication between the pressure chambers 10 and the ink discharge ports 8 respectively. The aperture plate 24 made of metal is provided with the apertures 12 corresponding to the pressure chambers 10 of the cavity plate 22, and communication holes 24*a* which make the communication between the pressure chambers 10 and the nozzles 8 respectively. In this arrangement, the apertures 12 are the flow passages to make the connection between the communication holes 23*a* of the base plate 23 and communication holes 25*a* of the supply plate 25 as described later on, which are formed for the aperture plate 24 by means of the half etching. The supply plate 25 made of metal is formed with communication holes 25*a* which make the communication between the apertures 12 and the subsidiary manifold 5*a* corresponding to the pressure chambers 10 of the cavity plate 22, and communication holes 25*b* which make the communication between pressure chambers 10 and the nozzles 8 respectively. Each of the manifold plates 26, 27, 28 made of metal is formed with the subsidiary manifold 5*a* and communication holes 26*a*, 27*a*, 28*a* which make the communication between the pressure chambers 10 and the nozzles 8 respectively corresponding to the pressure chambers 10 of the cavity plate 22. The cover plate 29 made of metal is formed with communication holes 29*a* which make the communication between the pressure chambers 10 and the nozzles 8 respectively corresponding to the pressure chambers 10 of the cavity plate 22. The nozzle plate 30 made of metal is formed with the nozzles 8 corresponding to the pressure chambers 10 of the cavity plate 22.

Figure 9:
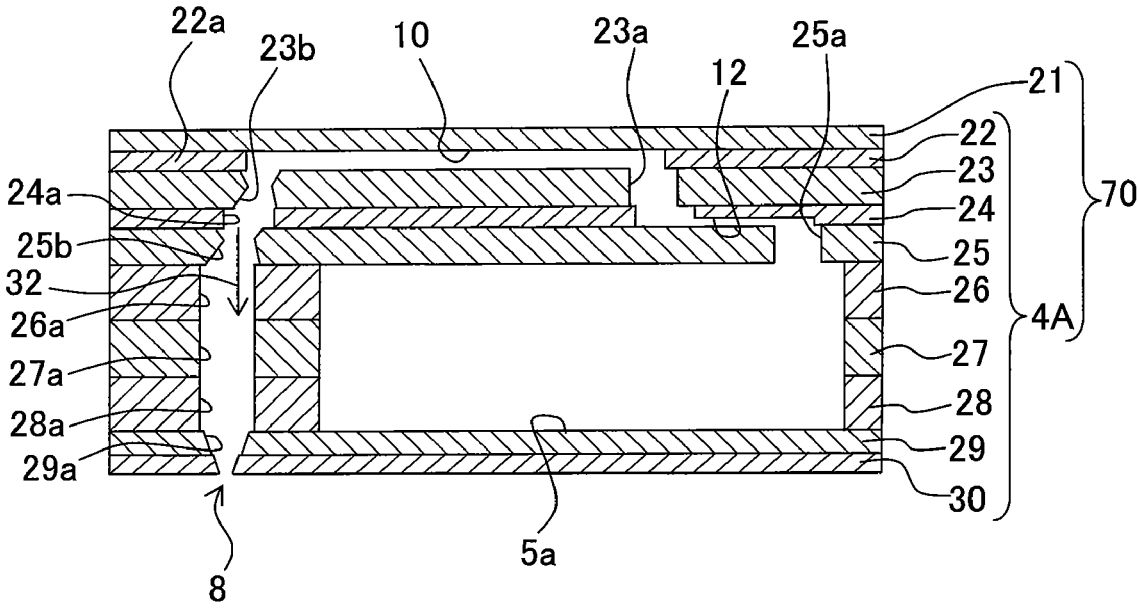
FIG. 9 shows a sectional view illustrating a stacked structure of the main head body.
Figure 10A:
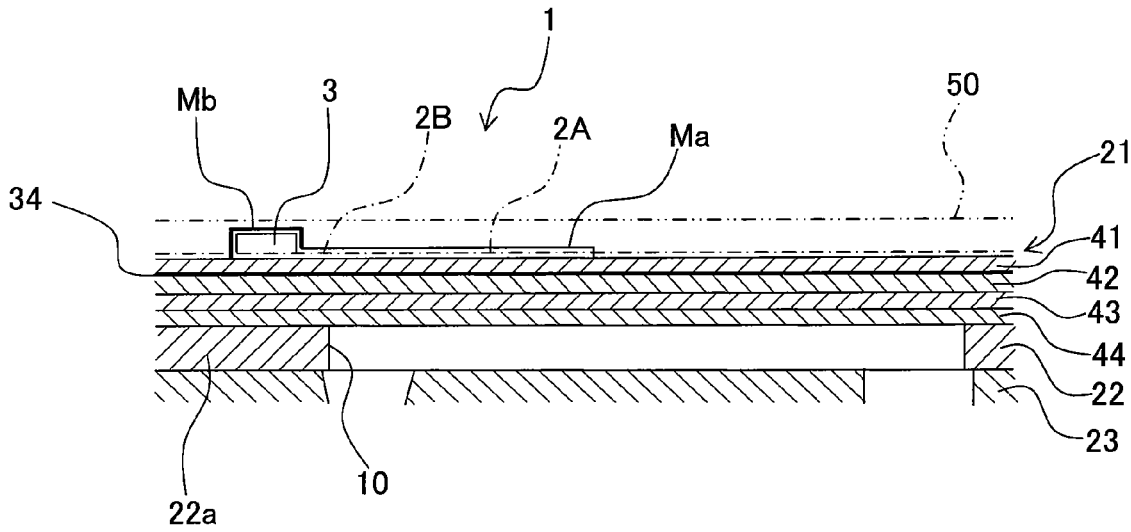

The ten sheets 21 to 30 are mutually positioned and stacked so that the individual ink flow passages 32 are formed as shown in FIG. 9. The ink, which is supplied from the unillustrated ink tank to the subsidiary manifold 5*a* along with the individual ink flow passage 32, is firstly directed from the subsidiary manifold 5*a* in the upward direction, and the ink is moved horizontally at the aperture 12. The ink is further directed in the upward direction, and the ink is moved horizontally at the pressure chamber 10 again. After that, the ink is directed obliquely downwardly in the direction to make separation from the aperture 12 for the time being, and then the ink is directed to the nozzle 8 downwardly in the vertical direction.

Figure 10B:
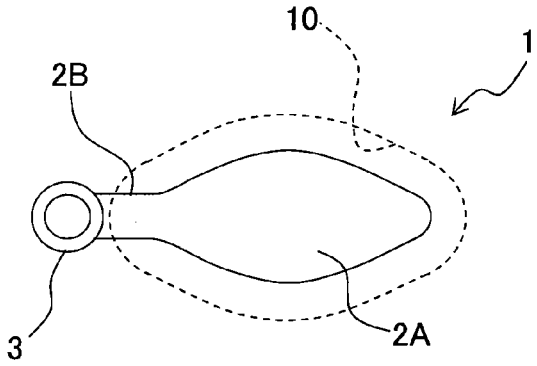

Next, the structure of the actuator unit 21 will be explained with reference to FIGS. 10A and 10B. FIG. 10A shows a magnified sectional view illustrating parts of FIG. 9 as viewed in the lateral direction. FIG. 10B shows a plan view illustrating the shapes of the connecting electrode section 3 and the individual electrode formed on the surface of the actuator unit 21. The individual electrode 1 is the same as or equivalent to that of the second embodiment described above.

The piezoelectric sheets 41 to 44 have approximately the same thickness (about 15 μm). The piezoelectric sheets 41 to 44 are layered flat plates (continued flat plate layers). The piezoelectric sheets 41 to 44 are arranged to range over the large number of pressure chambers 10 formed in one ink discharge area in the main head body 70. Therefore, it is possible to arrange the individual electrodes 1 at a high density on the piezoelectric sheet 41 by using, for example, the screen printing. The pressure chambers 10, which are formed at the positions corresponding to the individual electrodes 1, can be arranged at a high density as well. It is possible to print high resolution images. Each of the piezoelectric sheets 41 to 44 is composed of a ceramic material based on lead titanate zirconate (PZT) having the ferroelectric property.

The piezoelectric sheet 41, which is disposed at the uppermost layer, is arranged to cover the pressure chambers 10. The individual electrodes 1, each of which has a thickness of about 1 μm and each of which has the planar shape as shown in FIG. 10B, are formed at the positions corresponding to the pressure chambers 10, of the upper surface of the piezoelectric sheet 41. A common electrode 34, which has a thickness of about 2 μm and which is formed on the entire surface of the sheet, is arranged between the piezoelectric sheet 41 disposed at the uppermost layer and the piezoelectric sheet 42 disposed thereunder. On the contrary, no electrode is arranged between the piezoelectric sheet 42 and the piezoelectric sheet 43, between the piezoelectric sheet 43 and the piezoelectric sheet 44, and between the piezoelectric sheet 44 and the cavity plate 22. The common electrode 34 is one conductive sheet which extends over the substantially entire region in one actuator unit 21. The common electrode 34 is composed of, for example, a silver electrode material such as those based on the Ag—Pd system.

As for the common electrode 34, a large number of common electrodes 34, each of which has a size larger than that of the pressure chamber 10, may be formed for the respective pressure chambers 10 so that the respective pressure chambers are completely covered therewith. Alternatively, a large number of common electrodes 34, each of which has a size slightly smaller than that of the pressure chamber 10, may be formed for the respective pressure chambers 10 so that the respective pressure chambers are partially covered therewith. As described above, it is not necessarily indispensable that the common electrode 34 is one conductive sheet formed over the entire sheet surface. However, in the arrangement as described above, it is necessary that the common electrodes are electrically connected to one another so that all of the portions corresponding to the pressure chambers 10 have the same electric potential. The common electrode 34 is connected via through-holes (not shown) formed through the piezoelectric sheet 41 to the grounding electrodes 38 shown in FIG. 7. The grounding electrode 38 is joined to the terminal and the grounding wiring pattern of the wiring member 50. Therefore, the common electrode 34 is equivalently retained at the ground electric potential in the area corresponding to the pressure chamber 10. The individual electrode 1 is connected to the driver IC 80 via the wiring member 50 having the terminal 54 and the wiring pattern 52 which are independent for each of the individual electrodes 1 so that the electric potential can be controlled for each of the individual electrodes 1 corresponding to each of the pressure chambers 10.

Each of the piezoelectric sheets 41 to 44 has a thickness of about 15 μm. The individual electrodes 1, each of which has a thickness of about 1 μm, are formed on the piezoelectric sheet 41 disposed at the uppermost layer. The individual electrode 1 is formed of a silver electrode material such as those based on the Ag—Pd system. As shown in FIGS. 10A, 10B, the individual electrode 1 has the main electrode section 2A which has a substantially rhombic planar shape (length: 850 μm, width: 250 μm) that is substantially similar to the pressure chamber 10, and the subsidiary electrode section 2B which is led from one acute angle portion of the main electrode section 2A. The connecting electrode section 3, which has a diameter of about 160 μm and which is circular as viewed in a plan view, is provided at the left end disposed on the side opposite to the side of the main electrode section 2A, of the subsidiary electrode section 2B. The connecting electrode section 3 is composed of a silver electrode material such as those based on the Ag—Pd system. The gold coating Mb is applied to the surface thereof (including the upper surface and the respective side surfaces). The connecting electrode section 3 is electrically connected to the individual electrode 1. As described above, the connecting electrode section 3 may be formed of, for example, gold containing glass flit. The silver sulfide coating Ma is applied to the surfaces of the subsidiary electrode section 2B and the main electrode section 2A (including the upper surfaces and the respective side surfaces) of the individual electrode 1 except for the connecting electrode section 3 on the surface of the individual electrode 1.

The main electrode section 2A is provided in the area of the individual electrode 1 overlapped with the pressure chamber 10 as viewed in the stacking direction of the piezoelectric sheets 41 to 44. However, the subsidiary electrode section 2B is led from the main electrode section 2A to the area not overlapped with the pressure chamber 10. The connecting electrode section 3 is not included in the area overlapped with the pressure chamber 10 as well. In other words, the main electrode sections 2A are provided opposingly to the pressure chambers 10, and the connecting electrode sections 3 and the subsidiary electrode sections 2B are provided opposingly to the wall sections 22*a* on the piezoelectric type actuator which has the plurality of pressure chambers and which has the wall sections 22*a* for comparting the plurality of pressure chambers respectively.

As described above, the connecting electrode section 3 is joined and connected to the terminal 54 of the wired board 50 as shown in FIGS. 3A and 3B by the aid of the conductive brazing material, for example, the solder 6. The main electrode section 2A, on which the silver sulfide coating Ma is formed, is provided in the area overlapped with the pressure chamber 10. Therefore, the solder 6, which leaks from the position between the terminal 54 and the connecting electrode section 3 during the joining of the solder 6, is not retained on the side of the main electrode section 2A. Therefore, it is possible to avoid the influence exerted on the discharge characteristic which would be otherwise caused by the leaked solder 6 in relation to the pressure chamber 10.

The individual electrode 1 shown in FIG. 10 is the same as or equivalent to the individual electrode 1B of the second embodiment. However, it is possible to apply those of the first embodiment described above, the first to third modified embodiments, and combinations thereof, wherein it is possible to obtain the same or equivalent effect.

An explanation will now be made about the driving operation of the actuator unit 21 in the embodiment of the present invention. The piezoelectric sheets 41 to 44, which are included in the actuator unit 21, are previously polarized in the thickness direction thereof. Therefore, when the individual electrode 1 is allowed to have the electric potential different from that of the common electrode 34 to apply the electric field to the piezoelectric sheet 41 in the direction of polarization, the portion of the piezoelectric sheet 41, to which the electric field is applied, acts as the active portion which is elongated in the thickness direction (stacking direction) and which is shrunk in the direction perpendicular to the stacking direction, i.e., in the surface direction in accordance with the piezoelectric lateral effect. On the other hand, the remaining three piezoelectric sheets 42 to 44 are the inactive layers which have no area interposed by the individual electrode 1 and the common electrode 34, and hence they cannot be deformed spontaneously. In other words, the actuator unit 21 is constructed as the so-called unimorph type wherein the one piezoelectric sheet 41, which is disposed on the upper side (i.e., disposed separately from the pressure chamber 10), is the layer including the active portion, and the three piezoelectric sheets 42 to 44, which are disposed on the lower side (i.e., disposed closely to the pressure chamber 10), are the inactive layers.

Therefore, when the driver IC 80 is controlled so that the electric field has the same direction as that of the polarization to allow the individual electrode 1 to have the predetermined positive or negative electric potential with respect to the common electrode 34, then the active portion of the piezoelectric sheet 41, which is interposed by the common electrode 34 and the individual electrode 1, is shrunk in the surface direction, while the piezoelectric sheets 42 to 44 are not shrunk spontaneously. In this situation, the lower surfaces of the piezoelectric sheets 41 to 44 are secured to the upper surface of the partition wall for comparting the pressure chamber 10 formed in the cavity plate 22. Therefore, the piezoelectric sheets 41 to 44 are deformed (subjected to the unimorph deformation) so that they are convex toward the pressure chamber 10 in accordance with the shrinkage in the surface direction on the basis of the piezoelectric lateral effect. Accordingly, the volume of the pressure chamber 10 is decreased, the pressure of the ink is increased, and the ink is discharged from the ink discharge port 8. After that, when the electric potential of the individual electrode 1 is returned to the original electric potential, then the piezoelectric sheets 41 to 44 are allowed to have the original flat plate-shaped forms, and the volume of the pressure chamber 10 is returned to the original volume. Therefore, the ink is allowed to inflow from the manifold 5 into the pressure chamber 10.

Another driving method is also available. That is, the individual electrode 1 is allowed to previously have the electric potential different from that of the common electrode 34 so that the piezoelectric sheets 41 to 44 are deformed to be convex toward the pressure chamber 10. Every time when the discharge request is given, the individual electrode 1 is once allowed to have the same electric potential as that of the common electrode 34. After that, the individual electrode 1 is allowed to have the electric potential different from that of the common electrode 34 at a predetermined timing. In this case, the piezoelectric sheets 41 to 44 are returned to have the original shapes at the timing at which the individual electrode 1 and the common electrode 34 have the same electric potential. The volume of the pressure chamber 10 is increased as compared with the initial state (state in which the electric potentials of the both electrodes are different from each other). The ink is sucked from the side of the manifold 5 into the pressure chamber 10. After that, the piezoelectric sheets 41 to 44 are deformed so that they are convex toward the pressure chamber 10 again at the timing at which the individual electrode 1 is allowed to have the electric potential different from that of the common electrode 34. The pressure applied to the ink is increased in accordance with the decrease in the volume of the pressure chamber 10, and the ink is discharged.

When the direction of the electric field applied to the piezoelectric sheet 41 is opposite to the direction of polarization thereof, the active portion of the piezoelectric sheet 41, which is interposed by the individual electrode 1 and the common electrode 34, intends to elongate in the direction perpendicular to the direction of polarization. Therefore, the piezoelectric sheets 41 to 44 are deformed so that they are concave or recessed toward the pressure chamber 10 as a whole on the basis of the piezoelectric lateral effect. Therefore, the volume of the pressure chamber 10 is increased, and the ink is sucked from the side of the manifold 5. After that, when the electric potential of the individual electrode 1 is returned to the original electric potential, then the piezoelectric sheets 41 to 44 are allowed to have the original flat plate-shaped forms, and the volume of the pressure chamber 10 is returned to the original volume. Therefore, the ink is discharged from the ink discharge port 8.

Next, an explanation will be made about a method for producing the ink-jet head H provided with the discharge head constructed as described above. When the main head body 70 is manufactured, the following procedure is generally adopted. That is, the flow passage unit 4A and the actuator unit 21 are individually manufactured concurrently respectively, and then the both are joined to one another.

In order to manufacture the flow passage unit 4A, the etching is applied to the respective plates 22 to 30 for constructing the same by using, as masks, photoresists subjected to the patterning to form the open holes and the recesses on the respective plates 22 to 30 as shown in FIGS. 6 and 8 respectively. After that, the nine plates 22 to 30 are overlapped with each other while allowing the adhesive to intervene therebetween so that the ink flow passages 32 are formed as shown in FIG. 6, followed by being adhered to one another to manufacture the flow passage unit 4A.

Next, an explanation will be made about a method for manufacturing the actuator unit 21. A ceramic powder based on lead titanate zirconate (PZT), a binder, and a solvent are mixed with each other, and an obtained mixture is spread on a resin film such as PET (polyethylene terephthalate), followed by being dried to form a green sheet. The green sheet has a relatively large size to make it possible to form piezoelectric sheets of a plurality of the actuator units 20 with one green sheet.

A conductive paste of silver is printed on the surface of the green sheet to be formed into the piezoelectric sheet 41 so that a plurality of the individual electrodes 1B are formed. A conductive paste is printed on the surface of the green sheet to be formed into the piezoelectric sheet 42 so that the common electrode 34 is formed. The four green sheets, which are to be formed into the four piezoelectric sheets 41 to 44, are pressurized in the stacking direction so that they are integrated into one unit. After that, an area, which corresponds to the actuator unit 21 for one ink-jet head H, is cut out from the stack of the green sheets having a large size. The stack of the green sheets, which has been cut out, is sintered. The actuator unit 21 and the flow passage unit 4A are adhered to one another by using the adhesive to form the main head body 70.

A conductive paste containing Ag is thereafter printed in a such a state that the subsidiary electrode sections 2B of the plurality of individual electrodes 1B, which are formed in the areas not overlapped with the pressure chambers 10 as viewed in a plan view on the upper surface of the piezoelectric sheet 41, are covered with a metal mask having a large number of holes. Accordingly, the connecting electrode sections 3, which protrude in the semispherical forms, are formed on the plurality of subsidiary electrode sections 2B respectively.

After that, as described above, the gold coating Mb is formed on the silver electrode surfaces of the connecting electrode sections 3, and then the sulfurizing treatment is performed for the entire main head body 70 in a hydrogen sulfide atmosphere to form the silver sulfide coating Ma on the portions on which the gold coating Mb is not formed, of the silver electrode surfaces of the individual electrodes 1B. The bump of the solder 6 is thereafter affixed to the terminal 54 of the wired board 50 corresponding to each of the connecting electrode sections 3. The wired board 50 is pressed against the side of the piezoelectric sheet 41 in a state in which the solder 6 is allowed to intervene between the terminals 54 and the connecting electrode sections 3, followed by being heated and pressurized. Accordingly, the connecting electrode sections 3 of the individual electrodes 1B are joined to the wired board 50. When the connecting electrode section 3 is formed of the simple substance of gold or gold containing glass flit, the sulfurizing treatment is performed after the mask is printed and formed on the individual electrode 1B.

Thus, the gold coating or the mixture containing gold (including the simple substance of gold) is formed on the silver electrode surface of the connecting electrode section 3, and then the entire surface of the individual electrode 1B is sulfurized to form the silver sulfide coating on the surface except for the connecting electrode section 3, of the surface of the individual electrode 1B. Therefore, the affinity is defective with respect to the conductive brazing material in relation to the surface of the main electrode section 2A. Any excessive conductive brazing material or the solder is not adhered to the portion other than the connecting electrode section 3 during the joining process. It is possible to produce the discharge head in which the displacement of the piezoelectric type actuator exerts no influence on the discharge pressure applied to the pressure chamber.

The electrode section, which is to be defective in the affinity for the conductive brazing material thereafter, can be produced with ease such that the individual electrode 1 (1A, 1B), in which the gold coating is formed at the desired connecting portion or the desired connecting portion is formed of the mixture containing gold, is merely exposed for a predetermined period of time in the hydrogen sulfide atmosphere. The area which is satisfactory in the affinity for the conductive brazing material and the area which is defective in the affinity can be integrally formed with ease on the surface of the individual electrode 1.

As described above, according to the present invention, the individual electrode, which is formed on the discharge driving element, has the main electrode section 2A which is opposed to the driving area for driving the driving element and the subsidiary electrode section 2B which is opposed to the wall section. The connecting section or the connecting electrode section, which makes the connection while being opposed to the terminal 54 of the wiring member, is formed on the subsidiary electrode section 2B. The gold coating Mb is formed on the surface of the connecting section (connecting electrode section), or the connecting section (connecting electrode section) is formed of the mixture containing gold. The silver sulfide coating Ma is formed on the portions of the individual electrode surface except for the above. Therefore, when the terminal 54 and the connecting section (connecting electrode section) are joined to one another by using the conductive brazing material (solder), the terminal 54 and the connecting section (connecting electrode section) are reliably joined to one another electrically and mechanically, because the connecting section (connecting electrode section), to which the gold coating is applied, has the high affinity with respect to the conductive brazing material and the excellent wettability. Further, even when the conductive brazing material (solder) leaks from the position between the both, it is possible to avoid the leakage of the conductive brazing material, because the silver sulfide coating, which has the low affinity for the conductive brazing material (solder), is formed on the main electrode section 2A opposed to the driving area. The driving operation of the driving area is not inhibited. When the driving element is the piezoelectric actuator, and the driving area is opposed to the pressure chamber as in the liquid droplet discharge head such as the ink-jet head, then the vibration of the piezoelectric type actuator is not inhibited, and it is possible to avoid the influence on the pressure chamber. Therefore, it is possible to obtain the discharge head which discharges the liquid droplets without exerting any influence on the discharge characteristic. In other words, the conductive brazing material can be correctly adhered to only the desired connecting portion, and it is possible to effect the connection and the joining electrically and mechanically. Further, it is possible to obtain the discharge head in which no influence is exerted on the discharge characteristic.

The discharge head according to the present invention is also applicable, for example, to the ink-jet printer based on the serial printing system in which the printing paper is transported, and the main head body is allowed to perform the reciprocating movement in the direction perpendicular thereto to effect the printing, in addition to the ink-jet printer based on the line printing system as in the embodiments described above in which the printing paper is transported with respect to the fixed main head body to perform the printing. Further, the present invention is not limited to the ink-jet printer. The present invention is also applicable, for example, to the copy machine and the facsimile based on the ink-jet system. Additionally, the present invention is also applicable to the discharge apparatus to be used, for example, for the drawing system to be incorporated into the production line for electronic devices or the like.

What is claimed is:

1. A discharge head which discharges a liquid, comprising:

a discharge driving element which applies a discharge pressure to the liquid;

an individual electrode which is formed on the discharge driving element and which has a predetermined connecting section; and a wired board which has a terminal connected to the connecting section of the individual electrode and which is joined to the individual electrode with a conductive brazing material bridging between the terminal and the individual electrode, wherein the connecting section is provided to face the terminal, and a metal, which is hardly sulfurized, is exposed in a facing area of a surface of the connecting section facing the terminal; and a silver sulfide coating is formed on a portion, of a surface of the individual electrode, facing the terminal, the portion being different from the connecting section.

2. The discharge head according to claim 1, wherein a coating of the metal which is hardly sulfurized is formed in the facing area of the connecting section.

3. The discharge head according to claim 2, wherein the coating of the metal which is hardly sulfurized has a thickness of 0.01 to 0.1 μm.

4. The discharge head according to claim 1, wherein the connecting section is arranged closely to the individual electrode; the connecting section is electrically connected to the individual electrode; and the connecting section is formed of the metal which is hardly sulfurized, or a coating of the metal is formed on the facing area.

5. The discharge head according to claim 1, wherein the connecting section is a connecting electrode section which is provided as a connecting terminal formed on the surface of the individual electrode.

6. The discharge head according to claim 5, wherein a coating of the metal which is hardly sulfurized is formed in an area of a surface of the connecting electrode section, the area facing the terminal.

7. The discharge head according to claim 5, wherein the connecting electrode section is formed of the metal which is hardly sulfurized.

8. The discharge head according to claim 5, wherein the discharge head has a flow passage unit which has a plurality of pressure chambers and wall sections comparting the plurality of pressure chambers respectively;

the discharge driving element is an actuator, arranged on the flow passage unit;

the individual electrode is formed as a plurality of individual electrodes on the actuator, each of the individual electrodes having a main electrode section which faces one of the pressure chambers and a subsidiary electrode section which faces one of the wall sections; and the connecting electrode section is formed on the subsidiary electrode section, the silver sulfide coating being formed on an area, of a surface of the main electrode section, facing the terminal.

9. The discharge head according to claim 1, wherein the discharge head has a flow passage unit which has a plurality of pressure chambers and wall sections comparting the plurality of pressure chambers respectively;

the discharge driving element is an actuator arranged on the flow passage unit;

the individual electrode is formed as a plurality of individual electrodes on the actuator, each of the individual electrodes having a main electrode section which faces one of the pressure chambers and a subsidiary electrode section which faces one of the wall sections;

the subsidiary electrode section is the connecting section; and the silver sulfide coating is formed on an area of a surface of the main electrode section, the area facing the terminal.

10. The discharge head according to claim 1, wherein the individual electrode is a silver electrode, the conductive brazing material is solder, and the metal, which is hardly sulfurized, is gold.

11. The discharge head according to claim 1, wherein the silver sulfide coating has a thickness of 0.2 to 0.3 μm.

12. A method for producing a discharge head, comprising:

preparing a flow passage unit which has a plurality of pressure chambers and wall sections comparting the plurality of pressure chambers respectively;

arranging, on the flow passage unit, an actuator which applies a discharge pressure to each of the pressure chambers, the actuator including a plurality of individual electrodes formed thereon, and a wired board which has terminals, each of the individual electrodes having a main electrode section corresponding to one of the pressure chambers and a subsidiary electrode section corresponding to one of the wall sections, and facing each of the terminals, and the wired board being electrically connected to the actuator by joining an area between each of the terminals and the subsidiary electrode section with a conductive brazing material; and providing each of the individual electrodes as a silver electrode, and forming a silver sulfide coating on a surface of each of the individual electrodes before joining each of the terminals and the subsidiary electrode section.

13. The method for producing the discharge head according to claim 12, wherein a metal coating, of a metal which is hardly sulfurized, is formed on an area, of the subsidiary electrode section, facing the terminal, the surface of each of the individual electrodes is thereafter sulfurized, the silver sulfide coating is formed only on a surface of the silver electrode of the main electrode section, and then the subsidiary electrode section and each of the terminals are joined to each other with the conductive brazing material.

14. The method for producing the discharge head according to claim 13, wherein the metal coating, of the metal which is hardly sulfurized, has a thickness of 0.01 to 0.1 μm.

15. The method for producing the discharge head according to claim 12, wherein the subsidiary electrode section is formed of a metal which is hardly sulfurized, the main electrode section is formed of silver, the surface of each of the individual electrodes is sulfurized, and the silver sulfide coating is formed on the main electrode section, before the connecting section and each of the terminals are joined to each other with the conductive brazing material.

16. The method for producing the discharge head according to claim 12, wherein the silver sulfide coating has a thickness of 0.2 to 0.3 μm.

17. The method for producing the discharge head according to claim 12, wherein sulfurization is performed by a sulfurizing treatment in which exposure is effected for a predetermined period of time in a hydrogen sulfide atmosphere.

18. A method for producing a discharge head, comprising:

preparing a flow passage unit which has a plurality of pressure chambers and wall sections comparting the plurality of pressure chambers respectively;

arranging, on the flow passage unit, an actuator which applies a discharge pressure to each of the pressure chambers, the actuator including a plurality of individual electrodes formed thereon, and a wired board having terminals, each of the individual electrodes having a main electrode section corresponding to one of the pressure chambers and a subsidiary electrode section corresponding to one of the wall sections and having a connecting electrode section formed on the subsidiary electrode section, each of the terminals facing the connecting electrode section, and the wired board being electrically connected to the actuator by joining an area between each of the terminals and the connecting electrode section with a conductive brazing material; and providing each of the individual electrodes as a silver electrode, and forming a silver sulfide coating in area, of the main electrode section and the subsidiary electrode section, facing each of the terminals before joining the connecting electrode section and each of the terminals.

19. The method for producing the discharge head according to claim 18, wherein a metal coating, of a metal which is hardly sulfurized, is formed on an area of a surface of the connecting electrode section, the area facing each of the terminals; a surface of each of the individual electrodes is thereafter sulfurized; the silver sulfide coating is formed on a surface of the silver electrode of the main electrode section and a surface of the subsidiary electrode section, and then the connecting electrode section and each of the terminals are joined to each other with the conductive brazing material.

20. The method for producing the discharge head according to claim 19, wherein the metal coating, of the metal which is hardly sulfurized, has a thickness of 0.01 to 0.1 μm.

21. The method for producing the discharge head according to claim 18, wherein the connecting electrode section is formed of a metal which is hardly sulfurized; the main electrode section is formed of silver; a surface of each of the individual electrodes is sulfurized and the silver sulfide coating is formed on the main electrode section, before the connecting electrode section and each of the terminals are joined to each other with the conductive brazing material.

22. The method for producing the discharge head according to claim 18, wherein the silver sulfide coating has a thickness of 0.2 to 0.3 μm.

23. The method for producing the discharge head according to claim 18, wherein sulfurization is performed by a sulfurizing treatment in which exposure is effected for a predetermined period of time in a hydrogen sulfide atmosphere.

* * * * *